US011198296B2

(12) United States Patent
Kishigami et al.

(10) Patent No.: US 11,198,296 B2
(45) Date of Patent: Dec. 14, 2021

(54) LIQUID EJECTION HEAD

(71) Applicant: Brother Kogyo Kabushiki Kaisha, Nagoya (JP)

(72) Inventors: Toshihiro Kishigami, Obu (JP); Shotaro Kanzaki, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 15 days.

(21) Appl. No.: 16/834,676

(22) Filed: Mar. 30, 2020

(65) Prior Publication Data

US 2020/0307200 A1 Oct. 1, 2020

(30) Foreign Application Priority Data

Apr. 1, 2019 (JP) ..... JP2019-069580

(51) Int. Cl.
*B41J 2/14* (2006.01)
*B41J 2/18* (2006.01)
*B41J 2/175* (2006.01)

(52) U.S. Cl.
CPC ..... *B41J 2/14233* (2013.01); *B41J 2/14145* (2013.01); *B41J 2/17563* (2013.01); *B41J 2/18* (2013.01); *B41J 2/1433* (2013.01); *B41J 2002/14306* (2013.01); *B41J 2002/14403* (2013.01); *B41J 2002/14419* (2013.01); *B41J 2202/12* (2013.01)

(58) Field of Classification Search
CPC ..... B41J 2/17563; B41J 2/18; B41J 2/14145; B41J 2202/12; B41J 2002/14403; B41J 2002/14306; B41J 2002/14419; B41J 2/1433; B41J 2/14233
See application file for complete search history.

(56) References Cited

U.S. PATENT DOCUMENTS 8,534,810 B2 9/2013 Tsubaki
8,684,507 B2 * 4/2014 Uezawa ..... B41J 2/14233 347/89
2012/0062659 A1 3/2012 Tsubaki
2018/0178538 A1 6/2018 Miyazawa et al.

FOREIGN PATENT DOCUMENTS

JP 2002-326370 A 11/2002
JP 2012-056248 A 3/2012
JP 2018-103616 A 7/2018

* cited by examiner

*Primary Examiner* — Geoffrey S Mruk
(74) *Attorney, Agent, or Firm* — Banner & Witcoff, Ltd.

(57) ABSTRACT

A liquid ejection head includes an individual channel, a first manifold, a filter, a second manifold, and a bypass path. The individual channel has a nozzle. The first manifold is in fluid communication with the individual channel. The filter is disposed in the first manifold. The second manifold is in fluid communication with the individual channel. The bypass path is positioned across the filter from the individual channel with respect to a direction perpendicular to a surface extending direction of the filter. The bypass path provides fluid communication between the first manifold and the second manifold not via the individual channel.

20 Claims, 11 Drawing Sheets

LIQUID EJECTION HEAD

CROSS-REFERENCE TO RELATED APPLICATION

This application claims priority from Japanese Patent Application No. 2019-069580 filed on Apr. 1, 2019, the content of which is incorporated herein by reference in its entirety.

TECHNICAL FIELD

Aspects of the disclosure relate to a liquid ejection head that ejects liquid from nozzles.

BACKGROUND

An ink ejection head that ejects ink from nozzles has been known as a liquid ejection head that ejects liquid from nozzles. Such an ink ejection head includes a plurality of individual liquid chambers (e.g., individual channels), a common liquid chamber (e.g., a supply manifold), and a circulation common liquid chamber (e.g., a return manifold). The individual liquid chambers are in fluid communication with respective corresponding nozzles. The common liquid chamber allows ink to flow therefrom to the respective individual liquid chambers. The circulation common liquid chamber allows ink to flow thereinto from the respective individual liquid chambers. The ink ejection head further includes a filter disposed in the common liquid chamber. Such an ink ejection head may reduce or prevent precipitation of particles included in ink by ink circulation in which ink is caused to flow from the common liquid chamber to the circulation common liquid chamber via the individual liquid chambers.

SUMMARY

Nevertheless, each individual channel may impart a relatively high resistance to the flow of liquid therethrough. Thus, in a case where liquid is circulated via such individual channels in a liquid ejection head like the known ink ejection head, an amount of liquid to be circulated may be decreased. The filter disposed at a certain position in an ink flow route may also impart a relatively high resistance to the flow of the liquid therethrough. Thus, in a case where a filter is disposed in a supply manifold like the known ink ejection head and a return path is positioned downstream from the filter in an ink flow direction, the amount of liquid to be circulated may be decreased. If a sufficient amount of liquid is not circulated, precipitation of particles included in liquid might not be reduced sufficiently in the liquid ejection head.

Accordingly, aspects of the disclosure provide a liquid ejection head in which a sufficient amount of liquid may be surely circulated.

A liquid ejection head may include an individual channel, a first manifold, a filter, a second manifold, and a bypass path. The individual channel may have a nozzle. The first manifold may be in fluid communication with the individual channel. The filter may be disposed in the first manifold. The second manifold may be in fluid communication with the individual channel. The bypass path may be positioned across the filter from the individual channel with respect to a direction perpendicular to a surface extending direction of the filter. The bypass path may provide fluid communication between the first manifold and the second manifold not via the individual channel.

According to one or more aspects of the disclosure, the bypass path that may provide fluid communication between the first manifold and the second manifold may be positioned across the filter from the individual channel. Such a configuration may thus enable liquid to be circulated not via the filter and the individual channel, each of which may impart a relatively high resistance to the flow of liquid therethrough. Consequently, a sufficient amount of liquid may be surely circulated.

DETAILED DESCRIPTION

Hereinafter, an illustrative embodiment will be described with reference to the accompanying drawings.

General Configuration of Printer

Figure 1:
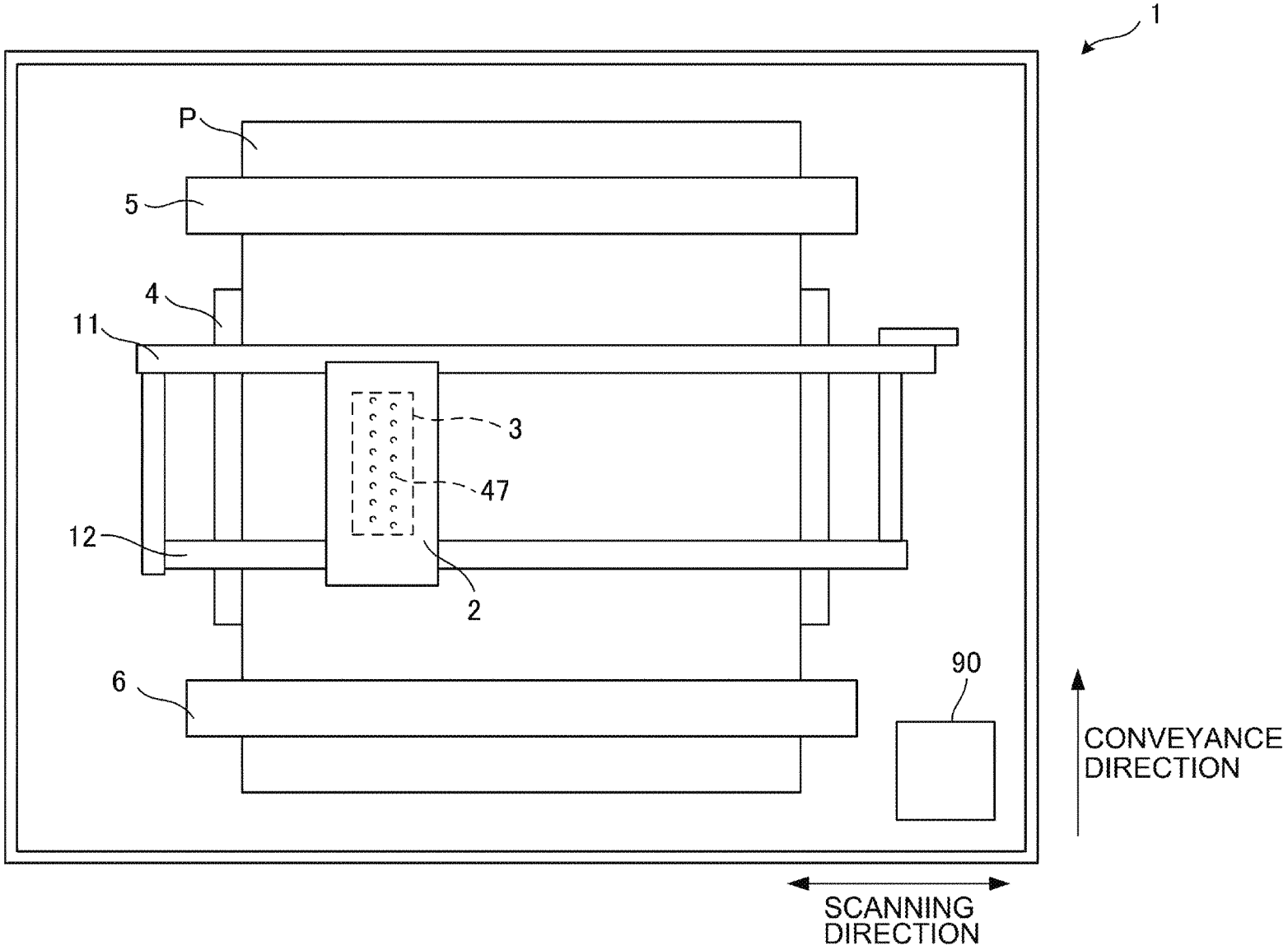
FIG. 1 is a plan view of a printer including an inkjet head according to an illustrative embodiment of the disclosure.

As illustrated in FIG. 1, a printer 1 includes a carriage 2, guide rails 11 and 12, an inkjet head 3 (e.g., a liquid ejection head), a platen 4, conveyance rollers 5 and 6, and an ink tank 90.

The carriage 2 is supported by the guide rails 11 and 12 extending in a scanning direction (e.g., a right-left direction in FIG. 1). The carriage 2 is configured to reciprocate in the scanning direction along the guide rails 11 and 12. The inkjet head 3 is mounted on the carriage 2. The inkjet head 3 is configured to move along the scanning direction together with the carriage 2. The inkjet head 3 is configured to be supplied with ink, via a tube, from the ink tank 90 storing ink. The inkjet head 3 has a plurality of nozzles 47 defined in a lower surface. The inkjet head 3 is configured to eject ink droplets from the nozzles 47.

The platen 4 is disposed facing the lower surface of the inkjet head 3 and extends in the scanning direction to cover the entire width of a recording sheet P to be conveyed. The platen 4 is configured to support from below a recording sheet P being conveyed. The conveyance roller 5 is disposed downstream from the carriage 2 in a conveyance direction (e.g., a direction from the bottom of the drawing sheet of FIG. 2 toward the top of the drawing sheet of FIG. 2) perpendicular to the scanning direction. The conveyance roller 6 is disposed upstream from the carriage 2 in the conveyance direction. The conveyance rollers 5 and 6 are configured to convey a recording sheet P in the conveyance direction.

The printer 1 is configured to perform printing on a recording sheet P by performing sheet conveyance and scanning alternately. In the sheet conveyance, the printer 1 conveys a recording sheet P by the conveyance rollers 5 and 6 by a certain distance in the conveyance direction. In the scanning, the printer 1 ejects ink droplets from one or more nozzles 47 of the inkjet head 3. That is, the printer 1 may be a serial printer. Hereinafter, a direction perpendicular to both the scanning direction and the conveyance direction may be referred to as an up-down direction.

Inkjet Head 3

Figure 2:
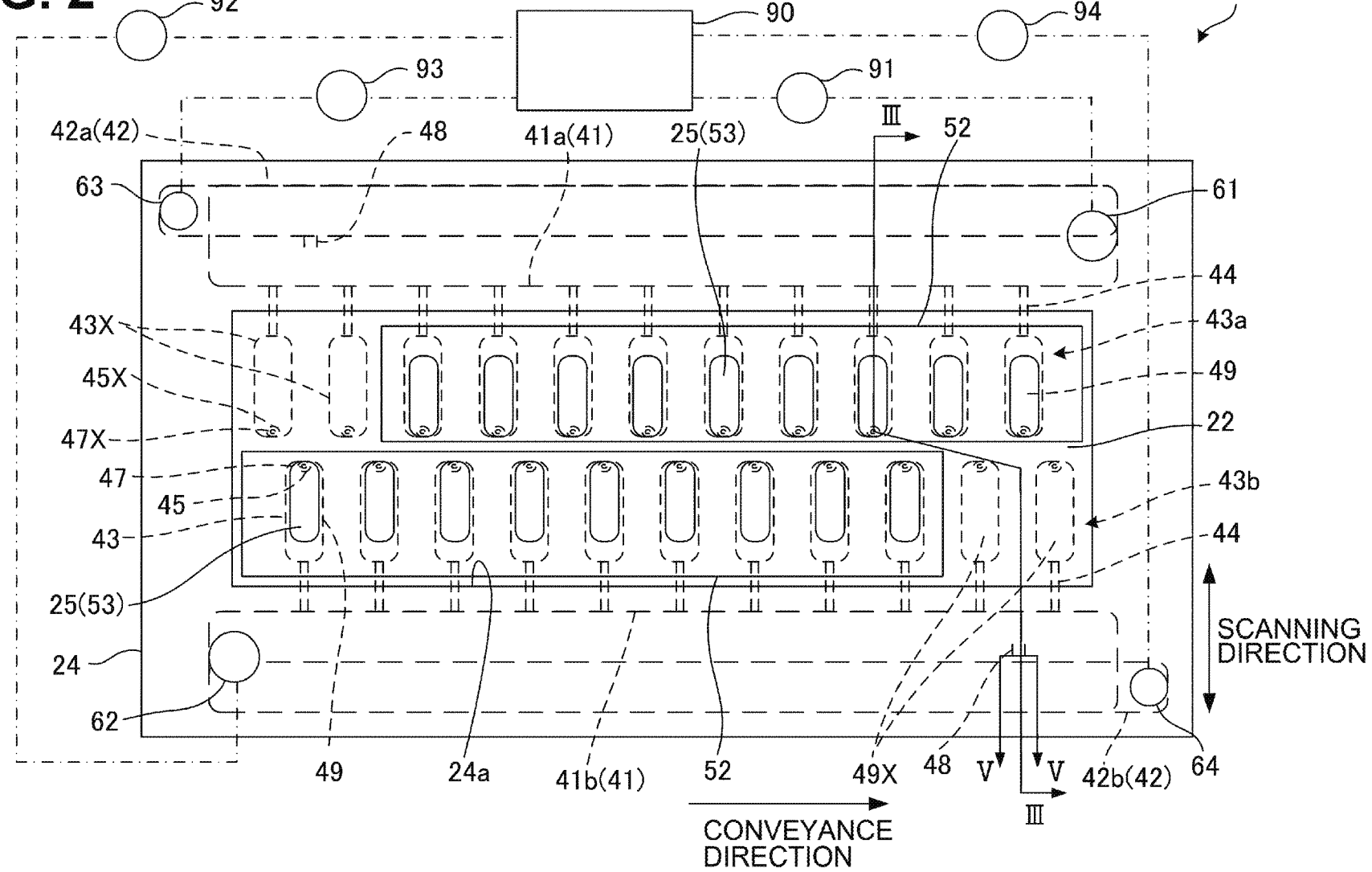
FIG. 2 is a plan view of the inkjet head of FIG. 1 according to the illustrative embodiment of the disclosure.
Figure 3:
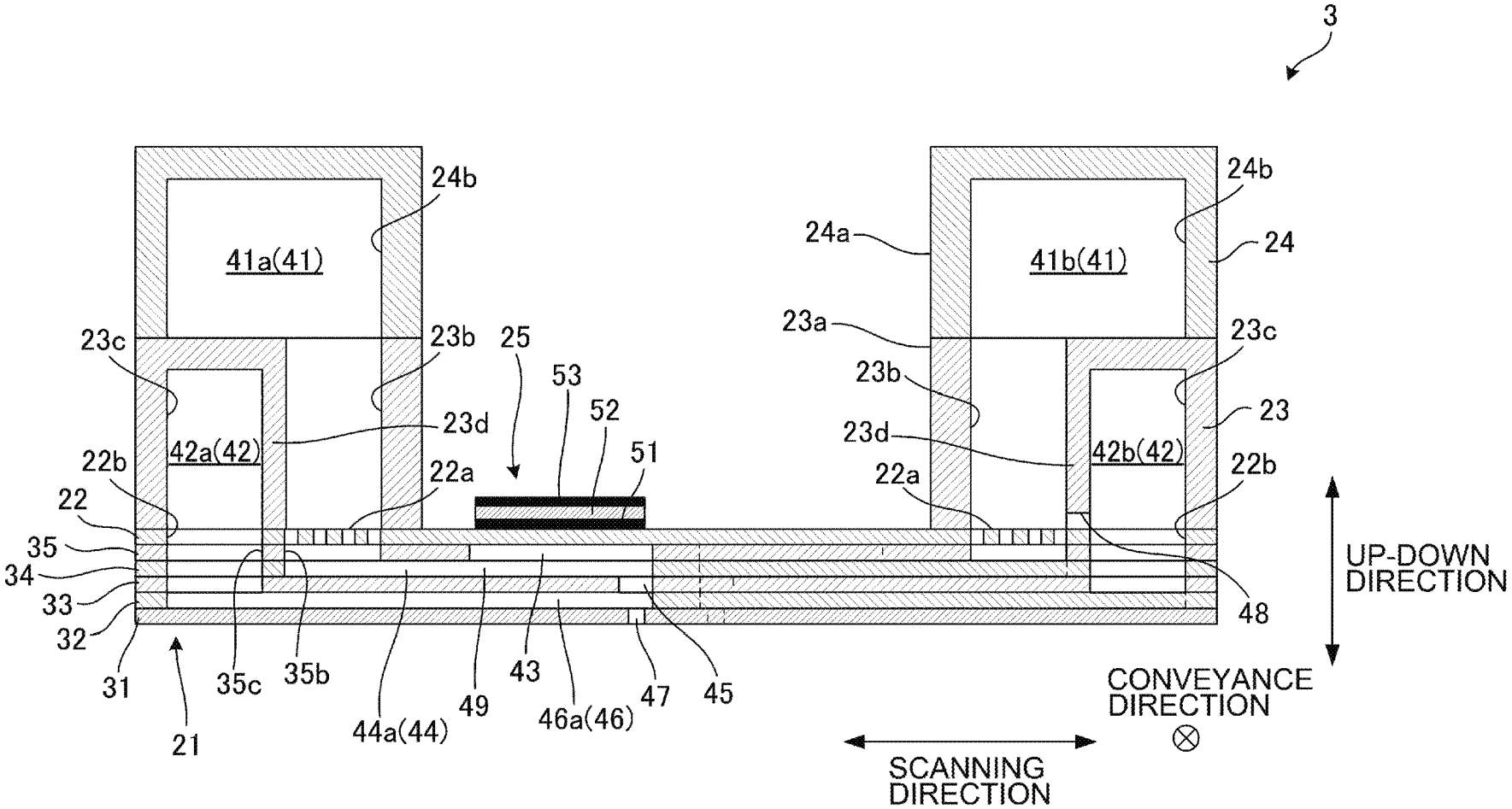
FIG. 3 is a sectional view taken along line of FIG. 2 according to the illustrative embodiment of the disclosure.

Referring to FIGS. 2 and 3, a detailed configuration of the inkjet head 3 will be described. As illustrated in FIG. 2, the inkjet head 3 has a rectangular shape in top plan view. More specifically, for example, when viewed in plan, longer sides of the inkjet head 3 extend in the conveyance direction. As illustrated in FIG. 3, the inkjet head 3 includes a channel member 21, a vibration plate 22, a first manifold member 23, a second manifold member 24, and piezoelectric elements 25 (only one of which is illustrated).

As illustrated in FIG. 2, the inkjet head 3 further includes a plurality of, for example, two supply manifolds 41*a* and 41*b*, a plurality of, for example, two return manifolds 42*a* and 42*b*, a plurality of individual channels 49, a plurality of dummy channels 49X, and communication paths 44 and 46 (refer to FIG. 3). In the description below, the supply manifolds 41*a* and 41*b* may be indicated by a common reference numeral "41" when not distinguishing therebetween. The return manifolds 42*a* and 42*b* may be also indicated by a common reference numeral "42" when not distinguishing therebetween.

As illustrated in FIG. 2, the return manifolds 42*a* and 42*b* both extend in the conveyance direction. The return manifolds 42*a* and 42*b* are positioned at respective end portions of the channel member 21 in the scanning direction. More specifically, for example, the return manifold 42*a* is positioned at one end portion of the channel member 21 in the scanning direction. The return manifold 42*b* is positioned at the other end portion of the channel member 21 in the scanning direction. With respect to the scanning direction, the side on which the return manifold 42*a* is positioned may refer to one side and the side on which the return manifold 41*a* is positioned may refer to the other side.

As illustrated in FIG. 2, the supply manifolds 41*a* and 41*b* both extend in the conveyance direction. The supply manifolds 41*a* and 41*b* are positioned at the respective end portions of the channel member 21 in the scanning direction. More specifically, the supply manifold 41*a* is positioned at the one end portion of the channel member 21 in the scanning direction. The supply manifold 41*b* is positioned at the other end portion of the channel member 21 in the scanning direction. Each of the supply manifolds 41 have a length shorter than a length of a corresponding one of the return manifolds 42 in the conveyance direction.

When the inkjet head 3 is viewed in top plan, the supply manifold 41*a* and the return manifold 42*a* are positioned such that their downstream ends (e.g., right ends in FIG. 2) in the conveyance direction are aligned with each other. The return manifold 42*a* extends beyond an upstream end (e.g., a left end in FIG. 2) of the supply manifold 41*a* in the conveyance direction. When the inkjet head 3 is viewed in top plan, the supply manifold 41*b* and the return manifold 42*b* are positioned such that their upstream ends (e.g., left ends in FIG. 2) in the conveyance direction are aligned with each other. The return manifold 42*b* extends beyond the downstream end (e.g., a right end in FIG. 2) of the supply manifold 41*b* in the conveyance direction.

As illustrated in FIG. 3, each of the supply manifolds 41*a* and 41*b* has a cross section having an inverted L-shape in a plane extending perpendicular to the conveyance direction. More specifically, for example, a particular portion of each of the supply manifolds 41*a* and 41*b* extends in the up-down direction and an upper portion of each of the supply manifolds 41*a* and 41*b* extends in the scanning direction toward a respective corresponding end of the inkjet head 3 in the scanning direction from the particular portion thereof. The supply manifold 41*a* is disposed such that the particular portion of the supply manifold 41*a* is positioned to the other side (e.g., the right) of the return manifold 42*a* in the scanning direction and the upper portion of the supply manifold 41*a* is positioned above the return manifold 42*a*. The particular portion and the upper portion of the supply manifold 41*a* are contiguous with each other. The supply manifold 41*b* is disposed such that the particular portion of the supply manifold 41*b* is positioned to the one side (e.g., the left) of the return manifold 42*b* in the scanning direction and the upper portion of the supply manifold 41*b* is positioned above the return manifold 42*b*. The particular portion and the upper portion of the supply manifold 41*b* are contiguous with each other.

When the inkjet head 3 is viewed in top plan, the individual channels 49 and the dummy channels 49X are positioned without overlapping the supply manifolds 41 and the return manifolds 42. Each individual channel 49 includes a pressure chamber 43, a descender 45, and a nozzle 47. The dummy channels 49X may have the same or similar configuration to the individual channels 49. That is, each dummy channel 49X includes a pressure chamber 43X, a descender 45X, and a nozzle 47X. The inkjet head 3 might not eject ink droplets from the nozzles 47X of the dummy channels 49X.

As illustrated in FIG. 2, the pressure chambers 43 corresponding to the respective individual channels 49 and the pressure chambers 43X corresponding to the respective dummy channels 49X are arranged in two rows, for example, pressure chamber rows 43*a* and 43*b*, and in a staggered pattern. More specifically, for example, the pressure chamber row 43*a* includes some of the pressure chambers 43 and some of the pressure chambers 43X aligned in the conveyance direction at equal intervals. The pressure chamber row 43*b* includes the remainder of the pressure chambers 43 and the remainder of the pressure chambers 43X aligned in the conveyance direction at equal intervals. The pressure chamber rows 43*a* and 43*b* are positioned next to each other in the scanning direction.

Each of the pressure chamber rows 43*a* and 43*b* includes two pressure chambers 43X of the respective dummy channels 49X. As illustrated in FIG. 2, the pressure chamber row 43*a* is positioned to the one side of the pressure chamber row 43*b* in the scanning direction. In the pressure chamber row 43*a*, the most and second most upstream pressure chambers in the conveyance direction (e.g., the leftmost and second leftmost pressure chambers in FIG. 2) may be the pressure chambers 43X. That is, the pressure chamber row 43*a* includes the pressure chambers 43X following the endmost one of the pressure chambers 43X. The pressure chamber row 43*b* is positioned to the other side of pressure chamber row 43*a* in the scanning direction. In the pressure chamber row 43*b*, the most and second most downstream pressure chambers in the conveyance direction (e.g., the rightmost and second rightmost pressure chambers in FIG. 2) may be the pressure chambers 43X. That is, the pressure chamber row 43*b* includes the pressure chambers 43X following the endmost one of the pressure chambers 43.

In each of the pressure chamber rows 43*a* and 43*b*, the dummy channels 49X include a first dummy channel 49X and a second dummy channel 49X corresponding to respective pressure chambers 43X that may be the endmost pressure chambers. The first dummy channel 49X (e.g., the dummy channel 49X corresponding the endmost pressure chamber 43X) is not next to the endmost one of the individual channels 49, and the second dummy channel 49X (e.g., the dummy channel 49X corresponding to the second endmost pressure chamber 43X) is next to the endmost one of the individual channels 49. The first dummy channel 49X may impart less resistance to the flow of ink therethrough than the second dummy channel 49X imparts a resistance to the flow of ink therethrough.

The pressure chambers 43 and 43X belonging to the pressure chamber row 43*a* are each in fluid communication with the supply manifold 41*a* via a respective corresponding communication path 44 (e.g., a second communication path). That is, the supply manifold 41*a* is provided in common for the pressure chambers 43 and 43X belonging to the pressure chamber row 43*a*. The communication paths 44 are provided for the pressure chambers 43 and 43X belonging to the pressure chamber row 43*a* in a one-to-one correspondence. Each communication path 44 is connected to one end of a corresponding one of the pressure chambers 43 and 43X in the scanning direction.

The pressure chambers 43 and 43X belonging to the pressure chamber row 43*b* are each in fluid communication with the supply manifold 41*b* via a respective corresponding communication path 44. That is, the supply manifold 41*b* is provided in common for the pressure chambers 43 and 43X belonging to the pressure chamber row 43*b*. The communication paths 44 are provided for the pressure chambers 43 and 43X belonging to the pressure chamber row 43*b* in a one-to-one correspondence. Each communication path 44 is connected to the other end of a corresponding one of the pressure chambers 43 and 43X in the scanning direction.

Referring to FIG. 3, the descenders 45 and 45X will be described in detail. All of the descenders 45 and 45X may have the same configuration, and therefore, one of the descenders 45 and 45X will be described. As illustrated in FIG. 3, a descender 45, 45X is positioned between a pressure chamber 43, 43X and a nozzle 47, 47X in the up-down direction. In FIG. 3, only one each of the descenders 45 and 45X, the pressure chambers 43 and 43X, and the nozzles 47 and 47X are illustrated. The descender 45, 45X is in fluid communication with the one end or the other end of a corresponding pressure chamber 43, 43X in the scanning direction. The end of the pressure chamber 43, 43X that is fluid communication with the descender 45, 45X is opposite to the end of the pressure chamber 43, 43X that is connected to a corresponding communication path 44. That is, the descender 45, 45X corresponding to the pressure chamber 43, 43X belonging to the pressure chamber row 43*a* is in fluid connection with the other end of the pressure chamber 43, 43X in the scanning direction. The descender 45, 45X corresponding to the pressure chamber 43, 43X belonging to the pressure chamber row 43*b* is in fluid connection with the one end of the pressure chamber 43 in the scanning direction.

As illustrated in FIG. 3, the descender 45, 45X that is in fluid communication with a corresponding pressure chamber 43, 43X belonging to the pressure chamber row 43*a* is in fluid communication with the return manifold 42*a* via a corresponding one of communication paths 46 (e.g., a first communication path). That is, the return manifold 42*a* is provided in common for the pressure chambers 43 and 43X belonging to the pressure chamber row 43*a*. The communication paths 46 are provided for the descenders 45 and 45X that are in fluid communication with the respective corresponding pressure chambers 43 and 43X belonging to the pressure chamber row 43*a* in a one-to-one correspondence.

In a similar manner to the descender 45, 45X that is in fluid communication with a corresponding pressure chamber 43, 43X belonging to the pressure chamber row 43*a*, the descender 45, 45X that is in fluid communication with a corresponding pressure chamber 43, 43X belonging to the pressure chamber row 43*b* is in fluid communication with the return manifold 42*b* via a corresponding one of the communication paths 46. That is, the return manifold 42*b* is provided in common for the pressure chambers 43 and 43X belonging to the pressure chamber row 43*b*. The communication paths 46 are provided for the descenders 45 and 45X that are in fluid communication with the respective corresponding pressure chambers 43 and 43X belonging to the pressure chamber row 43*b* in a one-to-one correspondence.

Referring to FIGS. 4A to 4E, a configuration of the channel member 21 will be described. As illustrated in FIG. 3, the channel member 21 includes a plurality of, for example, five plates 31, 32, 33, 34, and 35 laminated one above another in this order from below. The plates 31 to 35 have the same outside shape. For example, the plates 31 to 35 each have a rectangular shape having longer sides extending in the conveyance direction in top plan view.

Figure 4A:
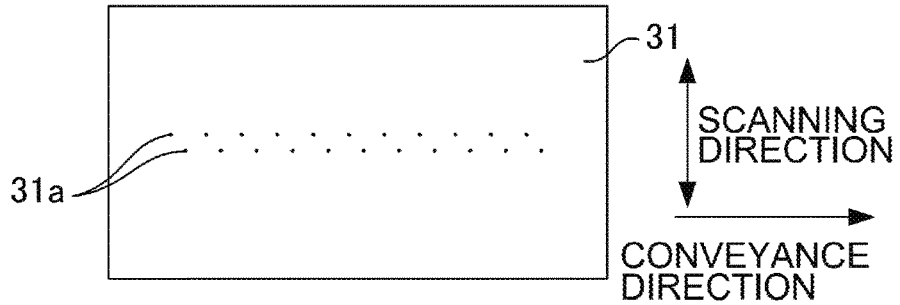
FIGS. 4A, 4B, 4C, 4D, and 4E are plan views each illustrating one of plates constituting a channel member according to the illustrative embodiment of the disclosure.

As illustrated in FIG. 4A, the plate 31 has a plurality of through holes 31*a* in its middle portion in the scanning direction. The through holes 31*a* are arranged in two rows and in a staggered pattern along the conveyance direction. The through holes 31*a* each have openings in respective surfaces of the plate 31. The openings of the through holes 31*a* in the lower surface of the plate 31 correspond to the respective nozzles 47 and 47X.

Figure 4B:
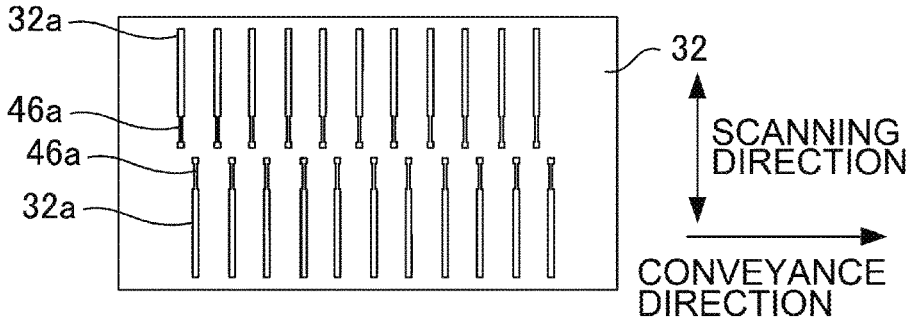

As illustrated in FIG. 4B, the plate 32 has a plurality of through holes 32*a*. The through holes 32*a* are arranged in two rows and in a staggered pattern along the conveyance direction. The through holes 32*a* are elongated in the scanning direction. The through holes 32*a* each constitute a particular portion of a descender 45, 45X that is in fluid communication with a corresponding nozzle 47, 47X and a particular portion of a corresponding communication path 46.

That is, the through holes 32*a* included in one row positioned to the one side of the other row in the scanning direction each have the other end portion in the scanning direction. The other end portion of each of the through holes 32*a* corresponds to a particular portion of a corresponding descender 45, 45X, and the remaining portion of each of the through holes 32*a* corresponds to a particular portion of a corresponding communication path 46. The through holes 32*a* included in the other row positioned to the other side of the one row in the scanning direction each have one end portion in the scanning direction. The one end portion of each of the through holes 32*a* corresponds to a particular portion of a corresponding descender 45, 45X, and the remaining portion of each of the through holes 32*a* corresponds to a particular portion of a corresponding communication path 46. Each through hole 32*a* has a narrowed portion 46*a* (e.g., a second narrowed portion) at its portion corresponding to a particular portion of a corresponding communication path 46. Each narrowed portion 46*a* is in fluid communication with a corresponding descender 45, 45X.

Figure 4C:
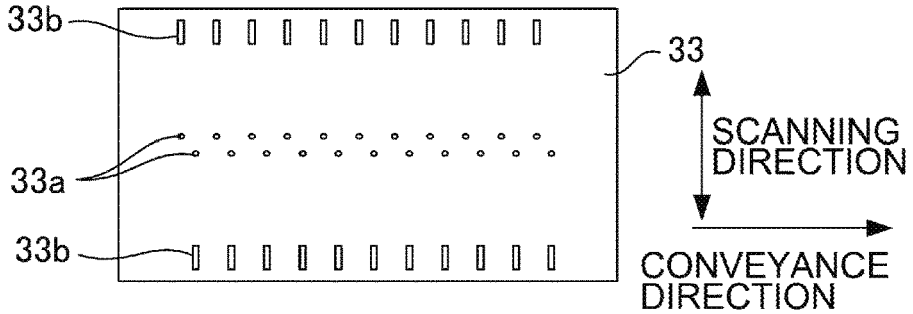

As illustrated in FIG. 4C, the plate 33 has a plurality of through holes 33*a* in its middle portion in the scanning direction. The through holes 33*a* are arranged in two rows and in a staggered pattern along the conveyance direction. The plate 33 further has a plurality of through holes 33*b* arranged in respective rows along the conveyance direction. The rows of the through holes 33*b* are positioned at respective end portions of the plate 33 in the scanning direction. Each through hole 33*a* constitutes a further particular portion of a corresponding descender 45, 45X. The plate 33 has the through holes 33*a* in its portion that may face the portion of the plate 32 where the through holes 32*a* constituting the particular portions of the respective descenders 45 and 45X are defined. Each through hole 33*b* constitutes a further particular portion of a corresponding communication path 46. The plate 33 has the through holes 33*b* in its further portions that may face the respective further portions of the plate 32. The end portions of the through holes 32*a* that might not constitute the particular portions of the respective descenders 45 and 45X in the scanning direction are defined in one or the other of the further portions of the plate 32. The plate 33 includes a wall portion (e.g., a first wall portion) serving as an upper wall surface of each communication path 46 between adjacent through holes 33*a* and 33*b*. The upper wall surface of each communication path 46 may extend parallel to perpendicular to the up-down direction (e.g., a perpendicular direction).

Figure 4D:
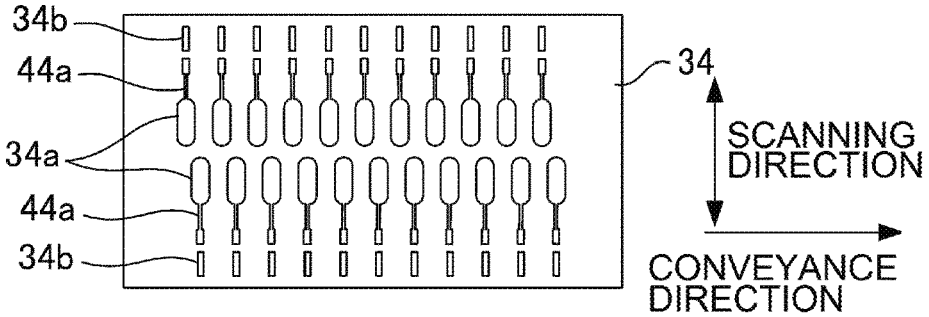

As illustrated in FIG. 4D, the plate 34 has a plurality of through holes 34*a* and a plurality of through holes 34*b*. The through holes 34*a* each include a narrowed portion 44*a* (e.g., a first narrowed portion). Each through hole 34*a* constitutes a particular portion of a corresponding pressure chamber 43, 43X, and a corresponding communication path 44 that is in fluid communication with the particular portion of the pressure chamber 43, 43X. Each through hole 34*b* constitutes a still further particular portion of a corresponding communication path 46.

Each through hole 34*a* extends toward one end or the other end of the plate 34 in the scanning direction from a portion of the plate 34 that may face the portion of the plate 33 where the through holes 33*a* are arranged in a staggered pattern. Each through hole 34*a* has a particular portion corresponding to a particular portion of a corresponding pressure chamber 43, 43X. The remaining portion of each through hole 34*a* corresponds to a corresponding communication path 44. The particular portion of each through hole 34*a* is closer to a middle portion of the plate 34 in the scanning direction than the remaining portion of each through hole 34*a* to the middle portion of the plate 34 in the scanning direction. Each through hole 34*a* includes a narrowed portion 44*a* (e.g., a second narrowed portion) at its portion corresponding to a corresponding communication path 44. Each narrowed portion 44*a* is in fluid communication with a corresponding pressure chamber 43, 43X. The plate 34 has the through holes 34*b* in its portion that may face the portion of the plate 33 where the through holes 33*b* are defined.

Figure 4E:
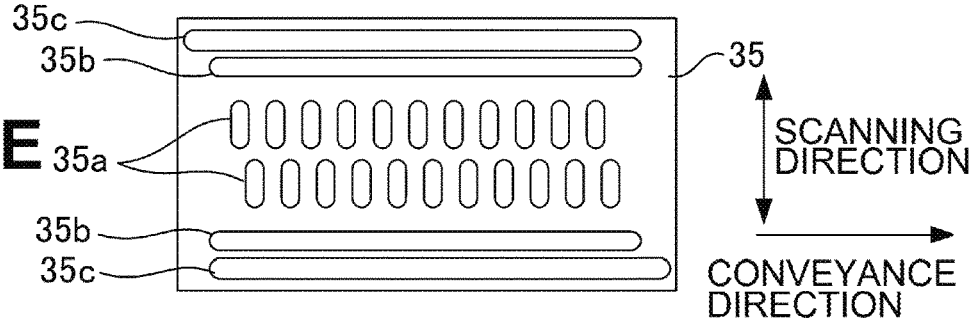

As illustrated in FIG. 4E, the plate 35 has a plurality of through holes 35*a*, a plurality of, two through holes 35*b*, and a plurality of, two through holes 35*c*. The through holes 35*a* are defined in a middle portion of the plate 35 in the scanning direction. The through holes 35*a* are arranged in two rows and in a staggered pattern along the conveyance direction. Each through hole 35*a* constitutes a further particular portion of a corresponding pressure chamber 43, 43X. Each through hole 35*b* constitutes a particular portion of a corresponding supply manifold 41 that is in fluid communication with corresponding ones of the communication paths 44. Each through hole 35*c* constitutes a particular portion of a corresponding return manifold 42 that is in fluid communication with corresponding ones of the communication paths 46.

The plate 35 has the through holes 35*a* in its portion that may face the portion of the plate 34 where the through holes 34*a* constituting the particular portions of the respective pressure chambers 43 and 43X are defined. The through holes 35*b* are defined in respective end portions of the plate 35 in the scanning direction and extend along the conveyance direction. More specifically, for example, the plate 35 has the through holes 35*b* in its respective portions, each of which may face a corresponding portion of the plate 34 where respective corresponding ones of the through holes 34*a* are defined. The through holes 35*b* may face one end portions or the other end portions of the respective corresponding ones of the through holes 34*a*. The one end portions or the other end portions of the through holes 34*a* may be end portions farther from the middle portion of the plate 35 than the opposite end portions of the same through holes 34*a* from the middle portion of the plate 35. Each through hole 35*c* is positioned across a corresponding through hole 35*b* from the through holes 35*a* in the scanning direction. Each through hole 35*c* extends along the conveyance direction. The plate 35 has the through holes 35*c* in its respective portions, each of which may face a corresponding portion of the plate 34 where the through holes 34*b* are defined. The plate 35 includes a wall portion (e.g., a second wall portion) serving as an upper wall surface of each communication path 44 between adjacent through holes 35*a* and 35*b*. The upper wall surface of each communication path 46 may extend parallel to perpendicular to the up-down direction (e.g., the perpendicular direction).

The plates 34 and 35 define the pressure chambers 43 and 43X. The plates 32 and 33 define the descenders 45 and 45X. The plates 32, 33, and 34 define the communication paths 46.

The vibration plate 22 has the same outside shape as the plates 31 to 35 in top plan view. The vibration plate 22 is laminated on an upper surface of the channel member 21, that is, an upper surface of the plate 35. As illustrated in FIG. 3, the vibration plate 22 includes a plurality of, two filters 22*a* at respective positions where the filters 22*a* may face the respective through holes 35*b* each constituting the particular portion of a corresponding supply manifold 41 of the plate 35. The vibration plate 22 further has through holes 22*b* each constituting a further particular portion of a corresponding return manifold 42. The vibration plate 22 has the through holes 22*b* in its respective portions that may face the portions of the plate 35 where the through holes 35*c* each constituting the particular portion of a corresponding return manifold 42 are defined.

The inkjet head 3 further includes a common electrode 51, a piezoelectric member 52, and individual electrodes 53 in this order from below on an upper surface of the vibration plate 22 at each particular portion that may face corresponding ones of the pressure chambers 43. A common electrode 51 and a piezoelectric member 52 are provided on a pressure chamber row basis. More specifically, for example, a common electrode 51 and a piezoelectric member 52 extend over the pressure chambers 43 belonging to a corresponding one of the pressure chamber rows 43*a* and 43*b*. An individual electrode 53 is provided on a pressure chamber basis. The individual electrodes 53 overlap the respective pressure chambers 43 in top plan view. An individual electrode 53, a particular portion of the common electrode 51 facing the individual electrode 53, and a particular portion of the piezoelectric member 52 facing the individual electrode 53 constitute a piezoelectric element 25. That is, piezoelectric elements 25 are disposed on the upper surface of the vibration plate 22 in a one-to-one correspondence to the pressure chambers 43. The piezoelectric elements 25 are positioned across the vibration plate 22 from the channel member 21 in a direction in which the channel member 21, the vibration plate 22, and the piezoelectric elements 25 are laminated. As illustrated in FIG. 2, no piezoelectric element 25 is provided for the pressure chambers 43X of the dummy channels 49X.

The individual electrodes 53 are connected to a driver IC via leads. The driver IC is configured to, while maintaining the potential of the common electrodes 51 at the ground potential, change the potential of appropriate ones of the individual electrodes 53. With such an operation of the driver IC, a portion of the vibration plate 22 and a portion of the piezoelectric member 52 both sandwiched between an individual electrode 53 and a pressure chamber 43 is deformed to protrude toward the pressure chamber 43. The volume of the pressure chamber 43 is thus reduced and pressure acting on ink in the pressure chamber 43 increases, thereby causing ink ejection from a corresponding nozzle 47 that is in fluid communication with the pressure chamber 43.

As illustrated in FIG. 3, the first manifold member 23 is laminated on the upper surface of the vibration plate 22 and out of position with respect to the piezoelectric elements 25. More specifically, for example, the first manifold member 23 is laminated on the upper surface of the vibration plate 22 without overlapping the piezoelectric elements 25 positioned on the upper surface of the vibration plate 22 in top plan view. The second manifold member 24 is laminated on an upper surface of the first manifold member 23. The first manifold member 23 and the second manifold member 24 have the same outside shape as the plates 31 to 35 and the vibration plate 22 in top plan view. The first manifold member 23 has an opening 23*a* for exposing the piezoelectric elements 25 therethrough. The second manifold member 24 has an opening 24*a* for exposing the piezoelectric elements 25 therethrough.

The first manifold member 23 has through holes 23*b* and grooves 23*c*. The through holes 23*b* penetrate the first manifold member 23 in the up-down direction. The grooves 23*c* may be recesses that may be recessed upward relative to a lower surface of the first manifold member 23 and each have an open lower end. As illustrated in FIG. 3, the first manifold member 23 has the through holes 23*b* and the grooves 23*c* in respective portions defined on opposite sides of the space for the piezoelectric elements 25 in the scanning direction. The through holes 23*b* are closer to the piezoelectric elements 25 than the grooves 23*c* are to the piezoelectric element 25 in the scanning direction.

Each through hole 23*b* constitutes a further particular portion of a corresponding supply manifold 41 and faces a corresponding filter 22*a* disposed at the vibration plate 22. Each groove 23*c* constitutes a still further particular portion of a corresponding return manifold 42 and faces a corresponding through hole 22*b* of the vibration plate 22.

The first manifold member 23 has a symmetric structure with respect to the center line thereof in the conveyance direction, and therefore, one of the halves of the first manifold member 23 will be described. As illustrated in FIG. 3, the first manifold member 23 includes a wall 23*d* that may be a partition wall. The wall 23*d* separates a supply manifold 41 and a return manifold 42. The wall 23*d* has surfaces extending perpendicular to the scanning direction to separate the supply manifold 41 and the return manifold 42 with respect to the scanning direction.

Figure 5:
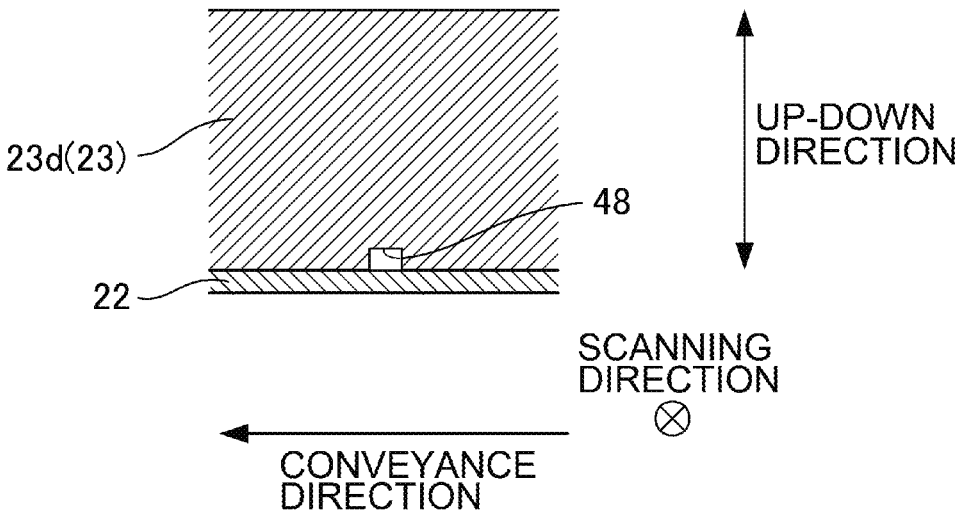
FIG. 5 is a partial sectional view of a first manifold member and a vibration plate taken along line V-V of FIG. 2 according to the illustrative embodiment of the disclosure.

The wall 23*d* has a cutout that may serve as a bypass path 48. The bypass path 48 provides fluid communication between the supply manifold 41 and the return manifold 42. More specifically, for example, the bypass path 48 provides fluid communication between the supply manifold 41 and the return manifold 42 not via the individual channels 49 and the dummy channels 49X. The bypass path 48 penetrates the wall 23*d* in the scanning direction. The bypass path 48 has an opening in each of the surfaces extending perpendicular to the scanning direction. As illustrated in FIG. 5, a cross section of the bypass path 48 in a plane perpendicular to the scanning direction may have a rectangular shape. The scanning direction may correspond to an ink flow direction in the bypass path 48.

A lower surface of the bypass path 48 may be defined by a particular portion of the vibration plate 22 between the filter 22*a* and the through hole 22*b* constituting the further particular portion of the return manifold 42 in the scanning direction. That is, the lower surface of the bypass path 48 is defined by the particular portion of the vibration plate 22 adjacent to the filter 22*a*. The bypass path 48 is positioned (e.g., above the filter 22*a* in FIG. 3) across the filter 22*a* from the plurality of individual channels 49 and the dummy channels 49X with respect to the up-down direction perpendicular to a surface extending direction of the filter 22*a*.

As illustrated in FIG. 2, the bypass path 48 providing fluid communication between the supply manifold 41*a* and the return manifold 42*a* is positioned in the conveyance direction between the dummy channels 49X including the respective pressure chambers 43X that may be the most upstream two pressure chambers (e.g., the leftmost and second leftmost pressure chambers) belonging to the pressure chamber row 43*a* in the conveyance direction in top plan view. The bypass path 48 providing fluid communication between the supply manifold 41*b* and the return manifold 42*b* is positioned in the conveyance direction between the dummy channels 49X including the respective pressure chambers 43X that may be the most downstream two pressure chambers (e.g., the rightmost and second rightmost pressure chambers) belonging to the pressure chamber row 43*b* in the conveyance direction in top plan view.

The second manifold member 24 has grooves 24*b*. The grooves 24*b* may be recesses that may be recessed upward relative to a lower surface of the second manifold member 24 and each have an open lower end. As illustrated in FIG. 3, the second manifold member 24 has the grooves 24*b* in respective portions defined on opposite sides of the space for the piezoelectric elements 25 in the scanning direction. The grooves 24*b* are positioned above the respective through holes 23*b* and the respective grooves 23*c* of the first manifold member 23. More specifically, for example, each groove 24*b* extends over both of a corresponding through hole 23 and a corresponding groove 23*c*.

That is, the plate 35 of the channel member 21 and the second manifold member 24 define the supply manifolds 41.

The filters 22*a* disposed at the vibration plate 22 are positioned inside the respective supply manifolds 41. In each supply manifold 41, ink is allowed to flow downward to pass through the filter 22*a*. Thus, if ink contains foreign matter, the filters 22*a* may catch foreign matter by their upper surfaces. The plate 35 of the channel member 21 and the first manifold member 23 define the return manifolds 42.

As illustrated in FIG. 2, the second manifold member 24 has an inlet 61 in its upper wall. The inlet 61 is positioned facing the downstream end portion (e.g., the right end portion in FIG. 2) of the supply manifold 41*a* in the conveyance direction. The second manifold member 24 has another inlet 62 in its upper wall. The inlet 62 is positioned facing the upstream end portion (e.g., the left end portion in FIG. 2) of the supply manifold 41*b* in the conveyance direction. The supply manifolds 41*a* and 41*b* are in fluid communication with the ink tank 90 via respective tubes connecting between the ink tank 90 and the inlets 61 and 62. A pump 91 is disposed between the ink tank 90 and the inlet 61 in an ink supply route. A pump 92 is disposed between the ink tank 90 and the inlet 62 in another ink supply route. The pumps 91 and 92 are configured to force ink into the corresponding supply manifolds 41*a* and 41*b* via the respective inlets 61 and 62.

The second manifold member 24 has an outlet 63 in its upper wall. The outlet 63 is positioned facing the upstream end portion (e.g., the left end portion in FIG. 2) of the return manifold 42*a* in the conveyance direction. The second manifold member 24 has another outlet 64 in its upper wall. The outlet 64 is positioned facing the downstream end portion (e.g., the right end portion in FIG. 2) of the return manifold 42*b* in the conveyance direction. The return manifolds 42*a* and 42*b* are in fluid communication with the ink tank 90 via respective tubes connecting between the ink tank 90 and the outlets 63 and 64. A pump 93 is disposed between the ink tank 90 and the outlet 63 in an ink return route. A pump 94 is disposed between the ink tank 90 and the outlet 64 in another ink return route. The pumps 93 and 94 are configured to force ink into the ink tank 90 via the respective outlets 63 and 64.

Hereinafter, a description will be provided on initial ink supply to the inkjet head 3. In a case where ink is supplied to the inkjet head 3 for the first time, the pumps 91 and 92 are driven to force ink to flow from the ink tank 90 into the supply manifolds 41*a* and 41*b* via the respective inlets 61 and 62. In the supply manifold 41*a* having the inlet 61 at its downstream end portion (e.g., the right end portion in FIG. 2) in the conveyance direction, ink supplied to the supply manifold 41*a* via the inlet 61 flows from downstream toward upstream in the conveyance direction (e.g., from right toward left in FIG. 2). Then, ink flows into each individual channel 49 via a corresponding communication path 44 in the arrangement order from the most downstream one of the individual channels 49 in the conveyance direction. Ink also flows into each dummy channel 49X positioned further upstream from the most upstream one of the individual channels 49 in the conveyance direction via a corresponding communication path 44.

In the supply manifold 41*b* having the inlet 62 at its upstream end portion (e.g., the left end portion in FIG. 2) in the conveyance direction, ink supplied to the supply manifold 41*b* via the inlet 62 flows into each individual channel 49 via a corresponding communication path 44 in the arrangement order from the most upstream one of the individual channels 49 in the conveyance direction. Ink also flows into each dummy channel 49X positioned further downstream from the most downstream one of the individual channels 49 in the conveyance direction via a corresponding communication path 44.

In the initial ink supply to the inkjet head 3, in addition to the individual channels 49, ink flows into the dummy channels 49X positioned opposite to the inlet 61 or 62 with respect to the endmost individual channel 49 that is farthest from the inlet 61 or 62 in the conveyance direction among the individual channels 49. In each of the pressure chamber rows 43*a* and 43*b*, the dummy channels 49X are positioned on opposite sides of the bypass path 48 in the conveyance direction. More specifically, for example, the first dummy channel 49X is positioned across the bypass path 48 from the endmost individual channel 49 and the second dummy channel 49X is positioned on the same side as the side where the endmost individual channel 49 is provided with respect to the bypass path 48. The first dummy channel 49X may impart less resistance to the flow of ink therethrough than the second dummy channel 49X imparts a resistance to the flow of ink therethrough. Such a configuration may thus ensure supply of ink to the first dummy channel 49X positioned across the bypass path 48 from the endmost individual channel 49. Consequently, such a configuration may reduce production of waste ink when ink is supplied to the inkjet head 3 for the first time.

Hereinafter, a description will be provided on ink circulation between the inkjet head 3 and the ink tank 90. In a case where ink circulation is implemented, the pump 91 is driven to force ink to flow from the ink tank 90 into the supply manifold 41*a* via the inlet 61 and the pump 92 is driven to force ink to flow from the ink tank 90 into the supply manifold 41*b* via the inlet 62. Some of ink supplied to the supply manifold 41*a* then flows therefrom into respective corresponding ones of the individual channels 49 and the dummy channels 49X via respective corresponding ones of the communication paths 44 after passing a corresponding filter 22*a*. Some of ink supplied to the supply manifold 41*b* then flows therefrom into respective corresponding ones of the individual channels 49 and the dummy channels 49X via respective corresponding ones of the communication paths 44 after passing a corresponding filter 22*a*. Some of ink supplied to the individual channels 49 and the dummy channels 49X then flows therefrom into the return manifold 42*a* or 42*b* via respective corresponding ones of the communication paths 46, each of which is in fluid communication with a corresponding one of the descenders 45 and 45X.

Some of ink supplied to the supply manifold 41*a* flows therefrom into the return manifold 42*a* via a corresponding bypass path 48 before reaching the corresponding filter 22*a*. Some of ink supplied to the supply manifold 41*b* flows therefrom into the return manifold 42*b* via a corresponding bypass path 48 before reaching the corresponding filter 22*a*. Then, the pump 93 is driven to force ink to flow into the ink tank 90 from the return manifold 42*a* via the outlet 63 and the pump 94 is driven to force ink to flow into the ink tank 90 from the return manifold 42*b* via the outlet 64.

A resistance Rb imparted to the flow of ink through a bypass path 48 is less than a combined resistance Ra that is the sum of individual resistances, each of which is a resistance imparted to the flow of ink through a path from a filter 22*a* to a communication path 44, a resistance imparted to the flow of ink through an individual channel 49, and a resistance imparted to the flow of ink through a dummy channel 49X.

As described above, each communication path 44 that provides fluid communication between a corresponding supply manifold 41 and a corresponding one of the pressure chambers 43 and 43X includes the narrowed portion 44*a*.

That is, each narrowed portion 44*a* provides fluid communication between a corresponding supply manifold 41 and a corresponding one of the individual channels 49 and the dummy channels 49X. Each communication path 46 that provides fluid communication between a corresponding return manifold 42 and a corresponding one of the descenders 45 and 45X includes the narrowed portion 46*a*. That is, each narrowed portion 46*a* provides fluid communication between a corresponding return manifold 42 and a corresponding one of the individual channels 49 and the dummy channels 49X. A cross-sectional area of each narrowed portion 44*a*, 46*a* in a plane perpendicular to the scanning direction has a size such that an average of pressures in an individual channel 49 or in a dummy channel 49X is negative. The scanning direction may correspond to a direction in which ink flows (hereinafter, referred to as the ink flow direction) in the bypass path 48.

The symbol "Ri" represents a channel resistance imparted to flow of ink through a channel from the pump 91, 92 for ink supply to an individual channel 49 or a dummy channel 49X via the supply manifold 41. The symbol "Ro" represents a channel resistance imparted to flow of ink through a channel from an individual channel 49 or a dummy channel 49X to the pump 93, 94 for ink collection via the return manifold 42. The symbol "Rc" represents a channel resistance imparted to flow of ink through an individual channel 49 or a dummy channel 49X. The symbol "Pi(≥0)" represents a pressure of the pump 91, 92 for ink supply. The symbol "Po(≤0)" represents a pressure of the pump 93, 94 for ink collection. A size of the cross-sectional area and a length of a narrowed portion 44*a* and a narrowed portion 46*a* are determined so as to satisfy Formula 1.

$$2(RoPi+RiPo)+Rc(Pi+Po)\leq 0 \qquad \text{Formula 1}$$

Where the symbol "Pm(≤0)" represents an average of pressures in an individual channel 49 or in a dummy channel 49X when a meniscus is broken at a corresponding nozzle 47, 47X, the size of the cross-sectional area and the length of each of a narrowed portion 44*a* and a narrowed portion 46*a* is determined so as to satisfy Formula 2 in addition to Formula 2.

$$\{2(RoPi+RiPo)+Rc(Pi+Po)\}/(Ri+Rc+Ro)\geq Pm \qquad \text{Formula 2}$$

Features of First Illustrative Embodiment

Note that plural same components have the same or similar configuration and function in the same or similar manner to each other. Therefore, one of the plural same components will be referred. According to the illustrative embodiment, the inkjet head 3 includes the plurality of individual channels 49, the supply manifold 41, the filter 22*a*, the return manifold 42, and the bypass path 48. The individual channels 49 each have a corresponding nozzle 47. The supply manifold 41 is in fluid communication with the individual channels 49. The filter 22*a* is disposed in the supply manifold 41. The return manifold 42 is in fluid communication with the individual channels 49. The bypass path 48 is positioned across the filter 22*a* from the plurality of individual channels 49 with respect to a direction perpendicular to a surface extending direction of the filter 22*a*. The bypass path 48 provides fluid communication between the supply manifold 41 and the return manifold 42 not via the individual channel 49. Positioning the bypass path 48 as such may enable ink to be circulated not via the filter 22*a* and the individual channels 49, each of which may impart a relatively high resistance to the flow of ink therethrough. Consequently, a sufficient amount of ink may be surely circulated.

In the illustrative embodiment, the inkjet head 3 further include the channel member 21, the vibration plate 22, the piezoelectric elements 25, the first manifold member 23, and the second manifold member 24. The channel member 21 has the individual channels 49. The vibration plate 22 is laminated on the channel member 21. The piezoelectric elements 25 are positioned on the upper surface of the vibration plate 22. The first manifold member 23 and the second manifold member 24 are positioned out of position with respect to the piezoelectric elements 25 in top plan view. That is, the piezoelectric elements 25 are positioned without overlapping the first manifold member 23 and the second manifold member 24 in top plan view. Such a configuration may thus reduce a height of the inkjet head 3 as compared with a case where the piezoelectric elements 25 are positioned with overlapping the first manifold member 23 and the second manifold member 24 in top plan view.

In the illustrative embodiment, the vibration plate 22 has the filter 22*a*. The inkjet head 3 might not thus require another plate for disposing such a filter 22*a*, thereby reducing a height of the inkjet head 3.

In the illustrative embodiment, the bypass path 48 may be a cutout defined at the lower end of the first manifold member 23. The lower surface of the bypass path 48 is defined by the particular portion of the vibration plate 22 adjacent to the filter 22*a*. That is, the lower surface of the bypass path 48 is flush with the upper surface of the filter 22*a*. With this configuration, foreign matter caught by the upper surface of the filter 22*a* may tend to be carried to the bypass path 48 by the flow of ink passing through the filter 22*a*, thereby reducing clogging of the filter 22*a* with foreign matter. Consequently, such a configuration may reduce or prevent increase of the channel resistance imparted to the flow of ink through the filter 22*a* caused by clogging of the filter 22*a*, thereby reducing or preventing decrease of the amount of ink to be circulated.

In the illustrative embodiment, the resistance Rb imparted to the flow of ink through a bypass path 48 is less than the combined resistance Ra that is the sum of individual resistances, each of which is a resistance imparted to the flow of ink through a path from a filter 22*a* to a communication path 44, a resistance imparted to the flow of in through an individual channel 49, and a resistance imparted to the flow of ink through a dummy channel 49X. Such a configuration may thus surely increase the amount of ink to be circulated as compared with a case where ink is circulated via the filter 22*a*, the individual channels 49, and the dummy channels 49X.

In the illustrative embodiment, the cross section of the bypass path 48 in a plane perpendicular to the scanning direction may have a rectangular shape. The scanning direction may correspond to an ink flow direction in the bypass path 48. With this configuration, a damping coefficient of the bypass path 48 may be greater than a damping coefficient of a bypass path having a circular cross section, thereby reducing resonance in the return manifold 42 sufficiently. Consequently, such a configuration may reduce or prevent degradation of a property of ejecting ink from the nozzles 47 caused by effect of such resonance.

A cross-sectional area of each narrowed portion 44*a*, 46*a* in a plane perpendicular to the scanning direction has a size such that an average of pressures in an individual channel 49 or in a dummy channel 49X is negative. Each narrowed portion 44*a* provides fluid communication between a supply manifold 41 and a corresponding individual channel 49 or dummy channel 49X. Each narrowed portion 46*a* provides fluid communication between a supply manifold 41 and a corresponding individual channel 49 or dummy channel 49X. That is, maintaining the pressure in the individual channels 49 and the dummy channels 49X at a negative pressure may reduce or prevent ink from leaking from the nozzles 47 and 47X.

In the illustrative embodiment, in each pressure chamber row 43*a* or 43*b*, two dummy channels 49X (e.g., the first and second dummy channels 49X) are positioned opposite to the inlet 61 or 62 with respect to the individual channel 49 (i.e., the endmost individual channel 49) that is farthest from the inlet 61 or 62 with respect to the conveyance direction among the individual channels 49. Ink may be supplied to the supply manifold 41 via the inlet 61 or 62. In each pressure chamber row 43*a* or 43*b*, the bypass path 48 is positioned across the second dummy channel 49X next to the endmost individual channel 49 from the inlet 61 or 62. Thus, a sufficient amount of ink may be flowed into the second dummy channel 49X that is closer to the inlet 61 or 62 than the bypass path 48 to the inlet 61 or 62, thereby reducing precipitation of particles included in ink in the second dummy channel 49X. Consequently, change in the property of the second dummy channel 49X may be reduced or prevented, thereby reducing affection on ejection property of the nozzle 47 that is in fluid communication with the individual channel 49 next to the second dummy channel 49X.

While the disclosure has been described in detail with reference to the specific embodiment thereof, this is merely an example, and various changes, arrangements and modifications may be applied therein without departing from the spirit and scope of the disclosure.

Figure 6:
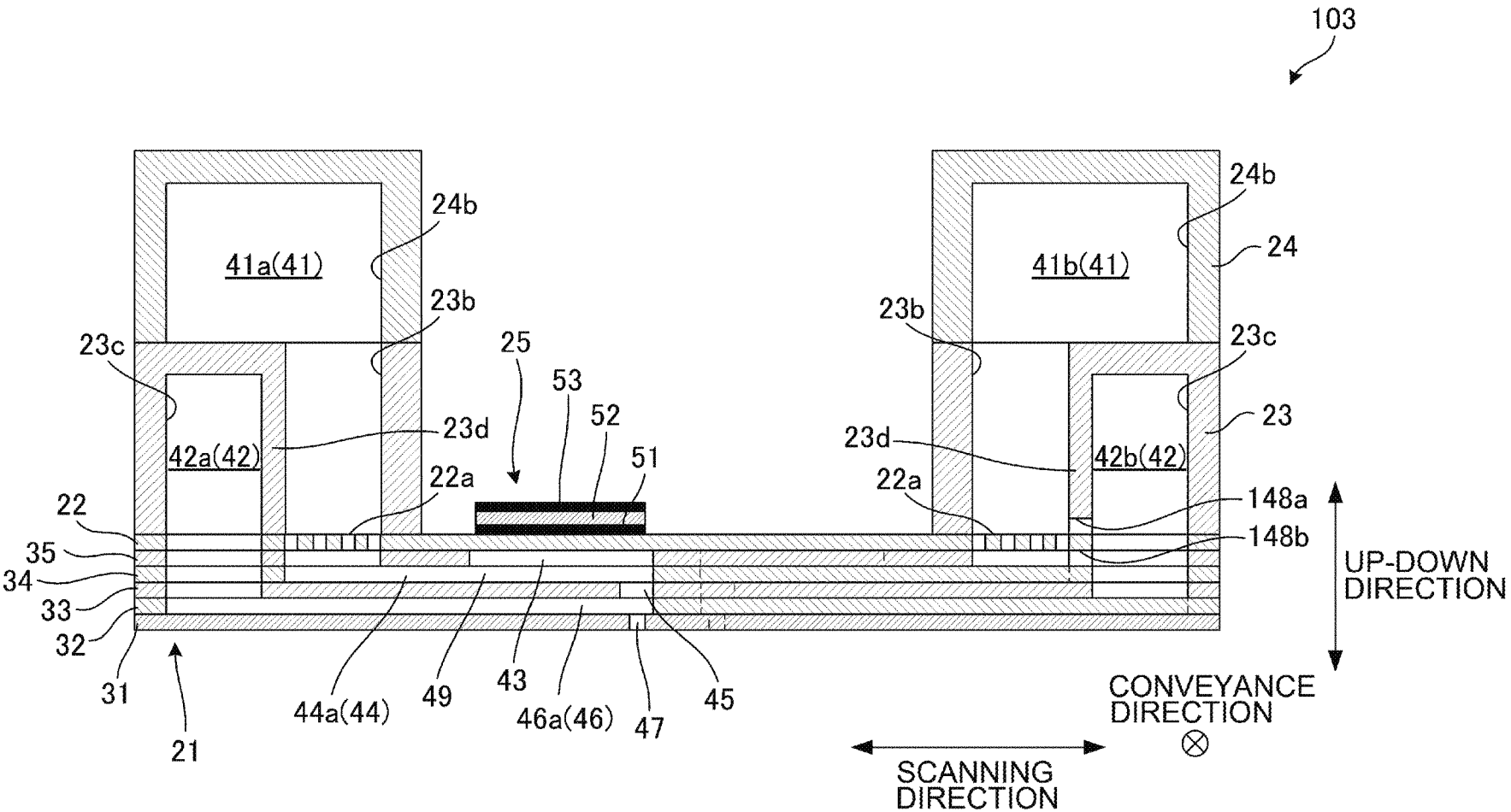
FIG. 6 is a sectional view of an inkjet head according to a first modification of the illustrative embodiment of the disclosure.

Referring to FIG. 6, an inkjet head 103 according to a first modification will be described. The inkjet head 103 has bypass paths 148*a* and 148*b* (only one each is illustrated). The bypass paths 148*a* may have the same configuration as each other and the bypass paths 148*b* may have the same configuration as each other, and therefore, a description will be provided on one of each of the bypass paths 148*a* and 148*b*. Other plural same components may also have the same or similar configuration and function in the same or similar manner to each other. Therefore, one of the plural same components will be described. The bypass paths 148*a* and 148*b* both provide fluid communication between a supply manifold 41 and a return manifold 42. The bypass path 148*a* (e.g., the first bypass path) may impart less resistance to the flow of ink therethrough than the bypass path 148*b* (e.g., the second bypass path) imparts a resistance to the flow of ink therethrough.

The bypass path 148*a* is positioned (e.g., above a filter 22*a* in FIG. 6) across the filter 22*a* from a plurality of individual channels 49 and dummy channels 49X (only one of which is illustrated) with respect to the up-down direction perpendicular to a surface extending direction of the filter 22*a*. The bypass path 148*a* is positioned between the dummy channels 49X in the conveyance direction in top plan view in a similar manner to the bypass path 48 of the illustrative embodiment.

With respect to the up-down direction perpendicular to the surface extending direction of the filter 22*a*, the bypass path 148*b* is positioned (e.g., below the filter 22*a* in FIG. 6) on the same side as the side where the plurality of individual channels 49 and the dummy channels 49X are provided with respect to the filter 22*a*. That is, the bypass path 148*b* is positioned between the filter 22*a* and the plurality of the individual channels 49.

Figure 7:
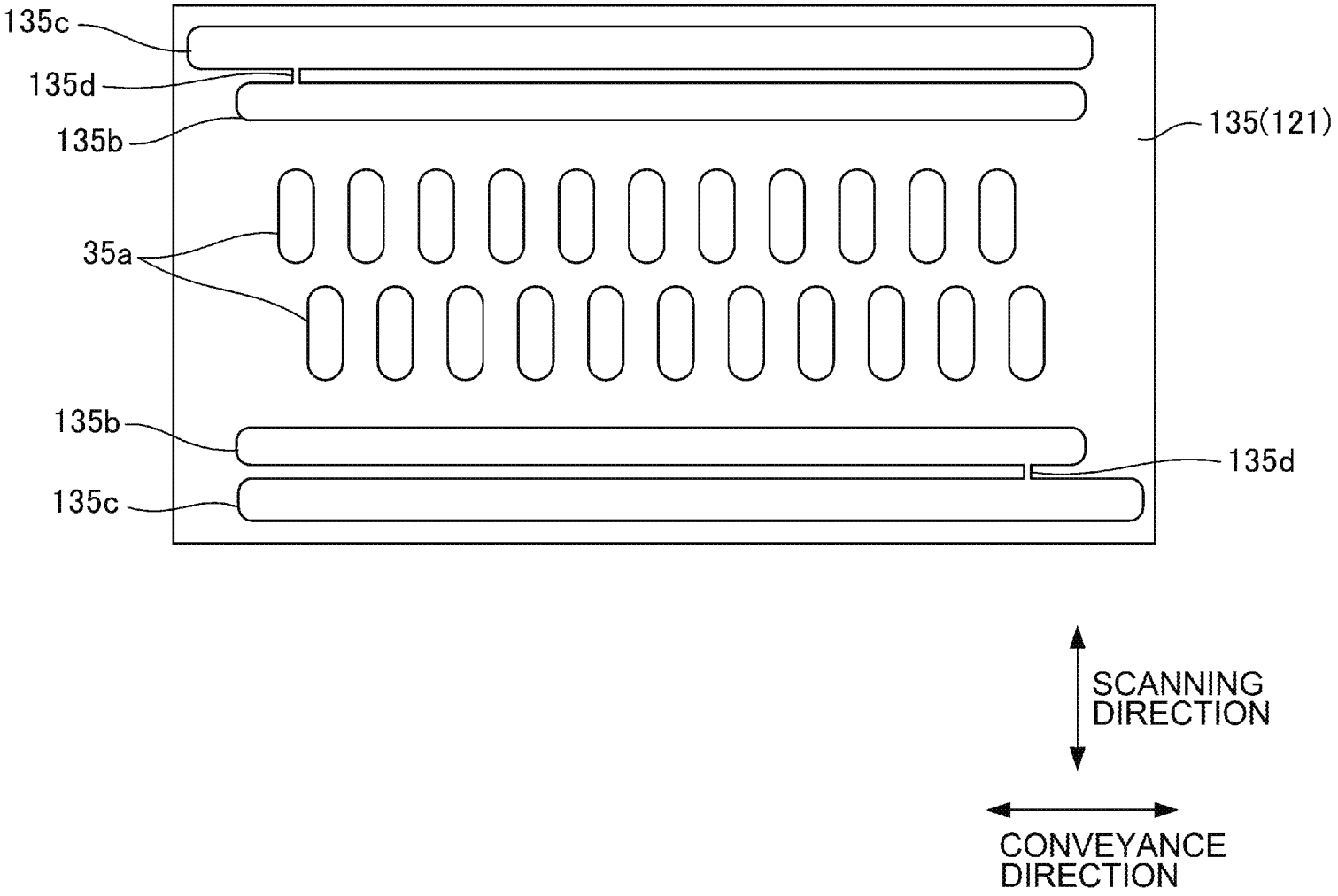
FIG. 7 is a plan view of one of plates constituting a channel member of FIG. 6 according to the first modification of the illustrative embodiment of the disclosure.

As illustrated in FIG. 7, a plate 135 that may be the topmost plate of five plates constituting a channel member 121 has through holes 135*d*. The through holes 135*d* serve as the respective bypass paths 148*b*. The plate 135 further has through holes 135*b* and through holes 135*c*. Each through hole 135*b* constitutes a particular portion of a corresponding supply manifold 41. Each through hole 135*c* constitutes a particular portion of a corresponding return manifold 42. Each through hole 135*d* is connected to a corresponding through hole 135*b* and a corresponding through hole 135*c*. In the first modification, the bypass path 148*b* overlaps the bypass path 148*a* in top plan view. Nevertheless, in other embodiments, for example, the bypass path 148*b* might not necessarily overlap the bypass path 148*a* in top plan view.

In the first modification, the bypass path 148*a* may allow ink to flow from the supply manifold 41 into the return manifold 42 above the filter 22*a*. In addition, the bypass path 148*b* may allow ink to flow from the supply manifold 41 into the return manifold 42 below the filter 22*a*.

The bypass path 148*a* may impart less resistance to the flow of liquid therethrough than the bypass path 148*b* imparts a resistance to the flow of ink therethrough. With this configuration, a sufficient amount of ink may flow to the bypass path 148*a*. Consequently, foreign matter caught by an upper surface of the filter 22*a* may tend to be carried to the bypass path 148*a*.

Figure 8:
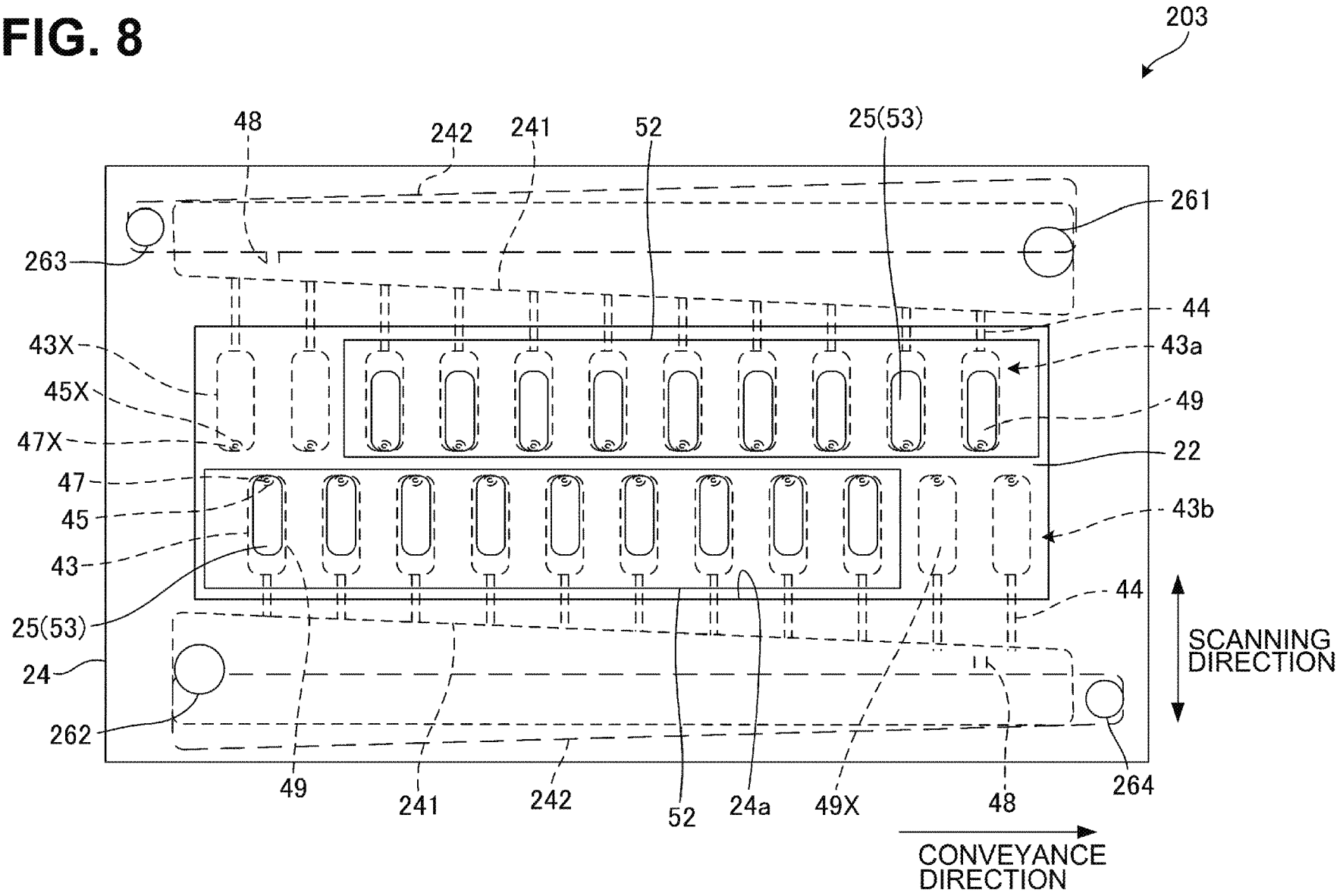
FIG. 8 is a plan view of an inkjet head according to a second modification of the illustrative embodiment of the disclosure.

Referring to FIG. 8, an inkjet head 203 according to a second modification will be described. The inkjet head 203 includes supply manifolds 241 and return manifolds 242 whose widths are not constant in the scanning direction. The supply manifolds 241 have the same configuration as each other and the return manifolds 242 have the same configuration as each other, and therefore, a description will be provided on one of each of the supply manifolds 241 and the return manifolds 242. Other plural same components may also have the same or similar configuration and function in the same or similar manner to each other. Therefore, one of the plural same components will be described. That is, the supply manifold 241 has ends in the conveyance direction. The ends of the supply manifold 241 each extend in the scanning direction. The end having an inlet 261, 262 has the widest width. The supply manifold 241 becomes gradually narrowed as the supply manifold 241 extends away from the inlet 261, 262. The return manifold 242 has ends in the conveyance direction. The ends of the return manifold 242 each extend in the scanning direction. The end opposite to the end having an outlet 263, 264 has the widest width. The return manifold 242 becomes gradually narrowed as the return manifold 242 extends toward the outlet 263, 264.

The supply manifold 241 and the return manifold 242 each have a constant height with respect to the conveyance direction. Thus, a cross-sectional area of a cross section of the supply manifold 241 in a plane perpendicular to the ink flow direction (e.g., a cross section perpendicular to the conveyance direction) in the supply manifold 241 becomes gradually smaller as the supply manifold 241 extends away from the inlet 261, 262. A cross-sectional area of a cross section of the return manifold 242 in a plane perpendicular to the ink flow direction (e.g., a cross section perpendicular to the conveyance direction) in the return manifold 242 becomes gradually smaller as the return manifold 242 extends toward the outlet 263, 264.

In the second modification, in each of the supply manifold 241 and the return manifold 242, a further downstream portion in the ink flow direction has a smaller cross-sectional area in a plane perpendicular to the ink flow direction. Such a configuration may thus reduce or prevent ink stagnation in the supply manifold 241 and the return manifold 242.

Figure 9:
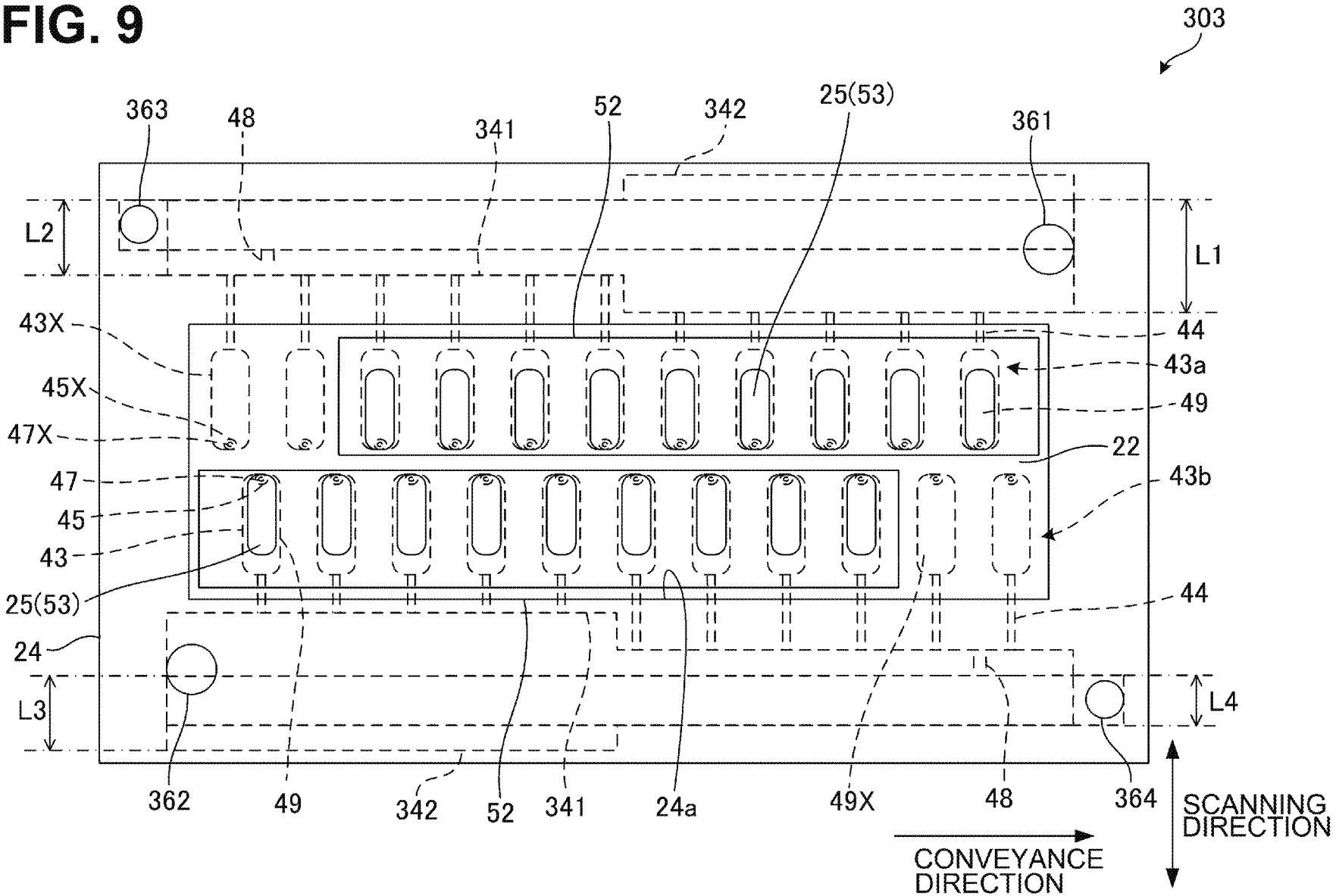
FIG. 9 is a plan view of an inkjet head according to a third modification of the illustrative embodiment of the disclosure.

Referring to FIG. 9, an inkjet head 303 according to a third modification will be described. The inkjet head 303 includes supply manifolds 341 and return manifolds 342 whose widths are not constant in the scanning direction. The supply manifolds 341 have the same configuration as each other and the return manifolds 342 have the same configuration as each other, and therefore, a description will be provided on one of each of the supply manifolds 341 and the return manifolds 342. Other plural same components may also have the same or similar configuration and function in the same or similar manner to each other. Therefore, one of the plural same components will be described. That is, the supply manifold 341 has ends in the conveyance direction. The ends of the supply manifold 341 each extend in the scanning direction. The end having an inlet 361, 362 has the widest width. The supply manifold 341 includes a narrowed portion. The supply manifold 341 becomes narrowed stepwise as the supply manifold 241 extends away from the inlet 361, 362. The return manifold 342 has ends in the conveyance direction. The ends of the return manifold 342 each extend in the scanning direction. The end opposite to the end having an outlet 363, 364 has the widest width. The return manifold 342 has a narrowed portion. The return manifold 342 becomes narrowed stepwise as the return manifold 342 extends toward the outlet 363, 364.

The supply manifold 341 has a width L1 from the center of the supply manifold 341 in the conveyance direction to its end having the inlet 361, 362, and a width L2(<L1) from the center of the supply manifold 341 to the other end opposite to the end having the inlet 361, 362 in the conveyance direction. That is, the supply manifold 341 includes a portion having a relatively wide width L1 and another portion having a relatively narrow width L2. The return manifold 342 includes a portion having a relatively wide width L3 and another portion having a relatively narrow width L4. The portion having the width L3 may include the end opposite to the end having the outlet 363, 364 with respect to the conveyance direction. The portion having the width L4 may include the end having the outlet 363, 364. The supply manifold 341 and the return manifold 342 may each include three or more portions having respective different widths.

The supply manifold 341 and the return manifold 342 each have a constant height with respect to the conveyance direction. Thus, a cross-sectional area of a cross section of the supply manifold 341 in a plane perpendicular to the ink flow direction (e.g., a cross section perpendicular to the conveyance direction) in the supply manifold 341 becomes smaller stepwise as the supply manifold 341 extends away from the inlet 361, 362. A cross-sectional area of a cross section of the return manifold 342 perpendicular to the ink flow direction (e.g., a cross section perpendicular to the conveyance direction) in the return manifold 342 becomes smaller stepwise as the return manifold 342 extends toward the outlet 363, 364.

Such a configuration may thus reduce or prevent ink stagnation in the supply manifold 341 and the return manifold 342 as is the case with the second modification.

Figure 10:
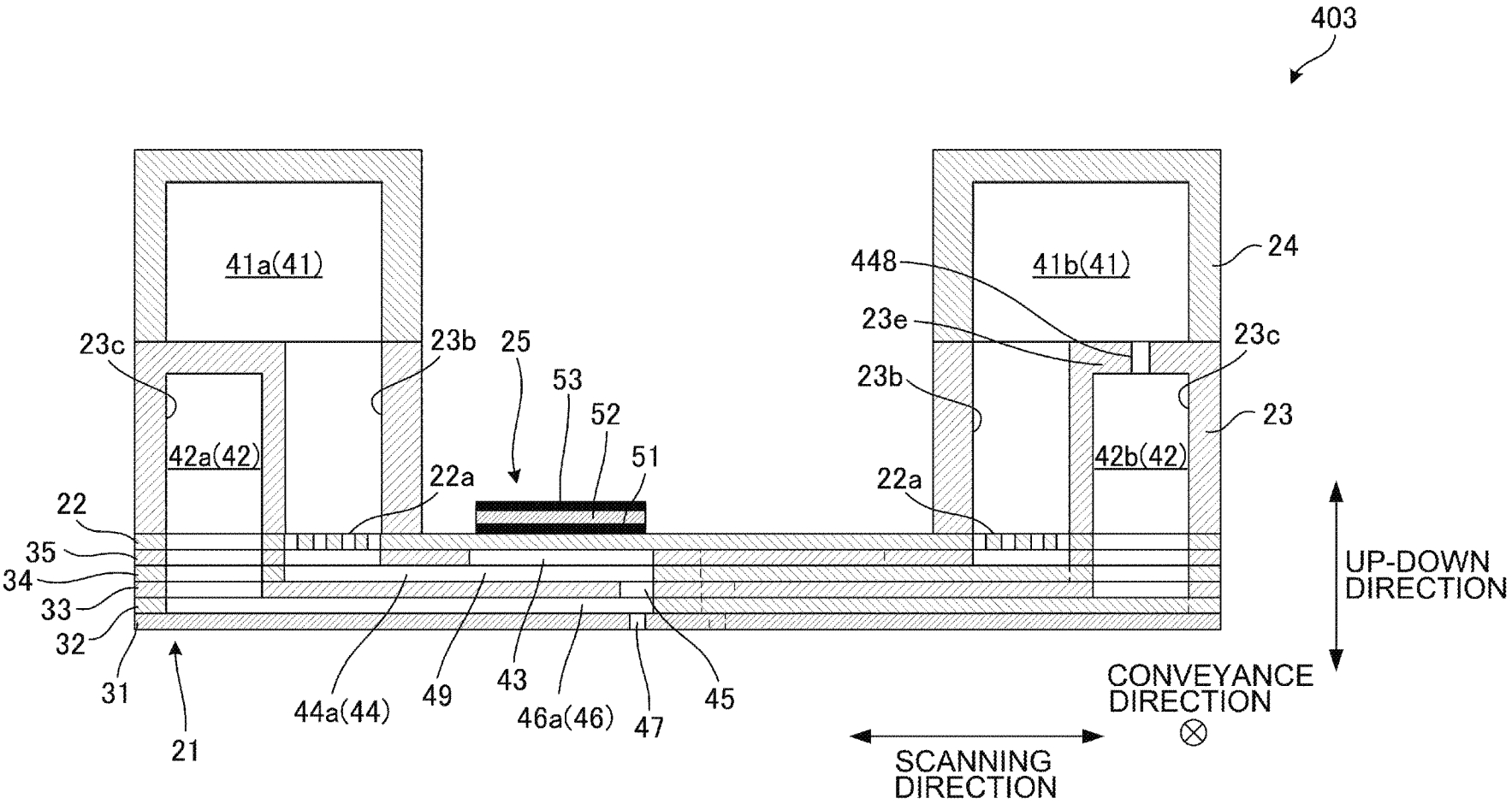
FIG. 10 is a sectional view of an inkjet head according to a fourth modification of the illustrative embodiment of the disclosure.

Referring to FIG. 10, an inkjet head 403 according to a fourth modification will be described. The inkjet head 403 includes bypass paths 448 (only one of which is illustrated). The bypass paths 448 may have the same configuration, and therefore, a description will be provided on one of the bypass paths 448. Other plural same components may also have the same or similar configuration and function in the same or similar manner to each other. Therefore, one of the plural same components will be described. The bypass path 448 is defined in a partition wall 23*e* separating a supply manifold 41 and a return manifold 42 in the up-down direction. That is, the bypass path 448 may be a through hole defined in the bottom of a groove 23*c* of a first manifold member 23 constituting a particular portion of the return manifold 42. The bypass path 448 has an opening in each surface of the partition wall 23*e* extending perpendicular to the scanning direction.

Figure 11:
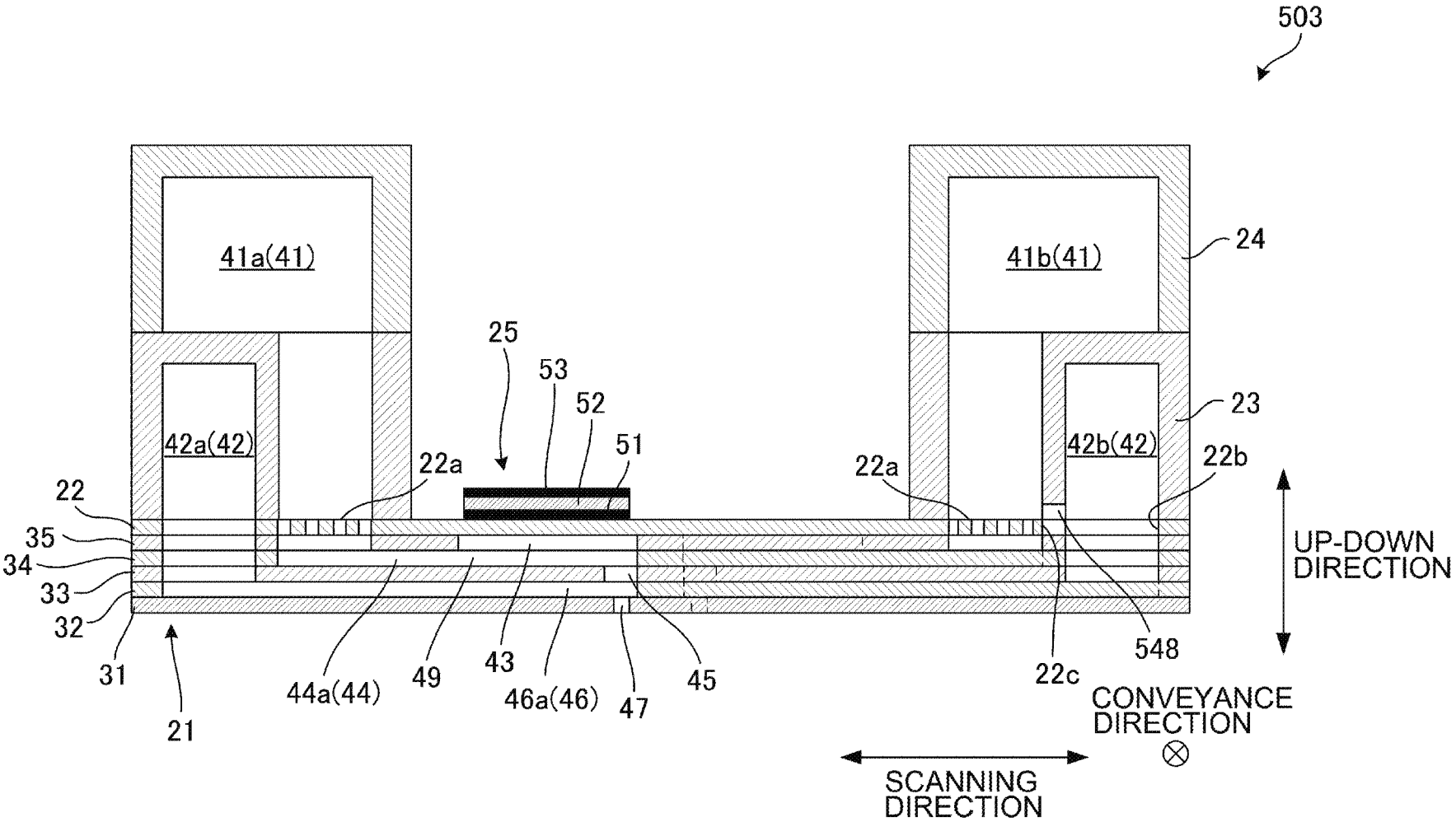
FIG. 11 is a sectional view of an inkjet head according to a fifth modification of the illustrative embodiment of the disclosure.

Referring to FIG. 11, an inkjet head 503 according to a fifth modification will be described. The inkjet head 503 has bypass paths 548 (only one of which is illustrated). The bypass paths 548 may have the same configuration, and therefore, a description will be provided on one of the bypass paths 548. Other plural same components may also have the same or similar configuration and function in the same or similar manner to each other. Therefore, one of the plural same components will be described. The bypass path 548 includes a cutout defined at a lower end of a first manifold member 23 and a through hole 22*c* defined in a vibration plate 22. The cutout defined at the lower end of the first manifold member 23 may have the same or similar configuration to the cutout defined at the lower end of the first manifold member 23 according to the illustrative embodiment. The through hole 22*c* is in communication with a through hole 22*b* constituting a particular portion of a return manifold 42 of the vibration plate 22. An upper surface of a plate 35 disposed below the vibration plate 22 serves as a lower surface of the bypass path 548.

In the fifth modification, the lower surface of the bypass path 548 is lower than the upper surface of the filter 22*a*. With this configuration, foreign matter caught by the upper surface of the filter 22*a* may tend to be carried to the bypass path 548 by the flow of ink passing through the filter 22*a*.

In the illustrative embodiment, the individual channels 49 and the dummy channels 49X are positioned without overlapping the supply manifold 41 and the return manifold 42 in top plan view. Nevertheless, in other embodiments, for example, the individual channels 49 and the dummy channels 49X may be positioned overlapping the supply manifold 41 and the return manifold 42 in top plan view.

In the illustrative embodiment, the piezoelectric elements 25 are positioned without overlapping the first manifold member 23 and the second manifold member 24 in top plan view. Nevertheless, in other embodiments, for example, the piezoelectric elements 25 may be positioned overlapping the first manifold member 23 and the second manifold member 24 in top plan view.

In the illustrative embodiment, the vibration plate 22 has the filter 22*a*. Nevertheless, in other embodiments, for example, another member may have such a filter 22*a*.

In the illustrative embodiment, the first manifold member 23 has the bypass path 48. Nevertheless, in other embodiments, for example, another member having the bypass path 48 may be disposed between the vibration plate 22 and the first manifold member 23.

In the illustrative embodiment, the cross section of the bypass path 48 in a plane perpendicular to the scanning direction may have a rectangular shape. The scanning direction at the bypass path 48 may correspond to the ink flow direction in the bypass path 48. The cross section of the bypass path 48 may have a rectangular shape having rounded corners within its tolerance or having rounded corners intentionally. The shape of the cross section of the bypass path 48 is not limited to a rectangle but may be a circle.

In the illustrative embodiment, the cross-sectional area and the length of each narrowed portion 44*a*, 46*a* are set such that an average of pressures in an individual channel 49 or in a dummy channel 49X is negative. Each narrowed portion 44*a* provides fluid communication between a supply manifold 41 and a corresponding individual channel 49 or dummy channel 49X. Each narrowed portion 46*a* provides fluid communication between a supply manifold 41 and a corresponding individual channel 49 or dummy channel 49X. Nevertheless, in other embodiments, for example, the cross-sectional area and the length of each narrowed portion 44*a*, 46*a* might not necessarily be set such that an average of pressures in an individual channel 49 or in a dummy channel 49X is negative. The narrowed portions 44*a* and 46*a* might not necessarily be provided.

In the illustrative embodiment, the plates 32, 33, and 34 define the communication paths 46 each providing a corresponding descender 45, 45X and a corresponding return manifold 42, and the plate 35, the vibration plate 22, and the first manifold member 23 define the return manifolds 42. Nevertheless, the communication paths 46 and the return manifolds 42 may be defined by other plates or members but not limited to the specific examples. In one example, only the plate 32 may define the communication paths 46, and the plates 33 to 35, the vibration plate 22, and the first manifold member 23 may define the return manifolds 42. In another example, the plates 32 and 33 may define the communication paths 46 and the plates 34 and 35, the vibration plate 22, and the first manifold member 23 may define the return manifolds 42. In still another example, the plates 32 to 35 may define the communication paths 46 and the vibration plate 22 and the first manifold member 23 may define the return manifolds 42.

In the illustrative embodiment, a single bypass path 48 is provided for the supply manifold 41*a* and the return manifold 42*a* and another single bypass path 48 is provided for the supply manifold 41*b* and the return manifold 42*b*. Nevertheless, in other embodiments, for example, two or more bypass paths 48 may be provided for a supply manifold 41 and a return manifold 42.

In the illustrative embodiment, in each pressure chamber row 43*a* or 43*b*, two dummy channels 49X are positioned opposite to the inlet 61 or 62 with respect to the individual channel 49 that is farthest from the inlet 61 or 62 with respect to the conveyance direction among the individual channels 49. Nevertheless, the number of dummy channels 49X is not limited to the specific example. In one example, one or three or more dummy channels 49X may be provided opposite to the inlet 61 or 62 with respect to the individual channel 49 that is farthest from the inlet 61 or 62 with respect to the conveyance direction among the individual channels 49. In another example, dummy channel 49X might not necessarily be provided.

In the illustrative embodiment, in each pressure chamber row 43*a* or 43*b*, the bypass path 48 is positioned across the second dummy channel 49X next to the endmost individual channel 49 from the inlet 61 or 62. Nevertheless, the position of the bypass path 48 is not limited to the specific example. In one example, at least one dummy channel 49X may be preferably provided between the bypass path 48 and the endmost individual channel 49 in the conveyance direction. That is, the bypass path 48 may be positioned opposite to the inlet 61 or 62 with respect to the dummy channel 49X that is farthest from the inlet 61 or 62 with respect to the conveyance direction among one or more dummy channels 49X. In another example, the bypass path 48 may be positioned between an individual channel 49 and a dummy channel 49X adjacent to each other. In still another example, the bypass path 48 may be positioned on the same side as the side where the inlet 61 or 62 is provided with respect to the individual channel 49 (i.e., the endmost individual channel 49) that is farthest from the inlet 61 or 62 with respect to the conveyance direction among the individual channels 49.

In the illustrative embodiment, no piezoelectric element 25 is disposed at the area overlapping the pressure chambers 43X corresponding to the dummy channels 49X in top plan view. Nevertheless, in other embodiments, for example, piezoelectric elements may be disposed at the area overlapping the pressure chambers 43X. In such a case, in one example, the individual electrodes 53 included in the respective piezoelectric elements 25 disposed at the area overlapping the pressure chambers 43X may be maintained at a constant potential. In another example, broken wires may be connected to the individual electrodes 53 disposed at the area overlapping the pressure chambers 43X.

In the illustrative embodiment, the dummy channels 49X have the same or similar configuration to the individual channels 49. That is, each dummy channel 49X includes a pressure chamber 43X, a descender 45X, and a nozzle 47X. Nevertheless, in other embodiments, for example, each dummy channel 49X might not necessarily include a nozzle 47X.

In the illustrative embodiment, the descenders 45 of the individual channels 49 and the descenders 45X of the dummy channels 49X are in fluid communication with the return manifold 42 via the respective corresponding communication paths 46. The dummy channel 49X that is farthest form the inlet 61 or 62 with respect to the conveyance direction among the dummy channels 49X requires less need for ink circulation, thereby not necessarily being in communication with the return manifold 42 via a communication path 46. Each of the individual channels 49 and each of the dummy channels 49X might not necessarily be in fluid communication with the return manifold 42 via a corresponding communication path 46.

In the illustrative embodiment, the filter 22*a* is disposed in the supply manifold 41 and the bypass path 48 is positioned across the filter 22*a* from the individual channels 49 with respect to the direction perpendicular to the surface extending direction of the filter 22*a*. Nevertheless, in other embodiments, for example, a filter 22*a* may be provided in the return manifold 42. In another example, a filter 22*a* may be provided in both the supply manifold 41 and the return manifold 42. In each case, also, the bypass path 48 may be positioned across the filter 22*a* from the individual channels 49 with respect to the direction perpendicular to the surface extending direction of the filter 22*a*.

In the illustrative embodiment, a piezoelectric actuator using piezoelectric elements is adopted. Nevertheless, in other embodiments, for example, another-type actuator such as a thermal actuator using heating elements or an electrostatic actuator using electrostatic force may be adopted.

The printing method adopted in the printer 1 is not limited to the serial printing. In other embodiments, for example, a line printing in which a head elongated in a sheet width direction and fixed at a certain position ejects ink droplets from nozzles may be adopted in the printer 1.

Liquid to be ejected from nozzles is not limited to ink but may be any liquid, for example, treatment liquid for flocculating or separating components of ink. The recording medium is not limited to a recording sheet P but may be, for example, a cloth or a substrate.

The disclosure may be applied to not only a printer but also a facsimile machine, a copying machine, or a multi-function device. Further, the disclosure may be applied to other liquid ejection devices used for purposes other than image recording. For example, the disclosure may be applied to a liquid ejection device configured to form conductive patterns on a surface of a substrate by ejecting conductive liquid onto the substrate.

What is claimed is:

1. A liquid ejection head comprising:

an individual channel having a nozzle;

a first manifold being in fluid communication with the individual channel;

a filter disposed in the first manifold;

a second manifold being in fluid communication with the individual channel;

a plurality of members laminated one above another in a laminating direction, wherein the plurality of members include:

a channel member having the individual channel;

a vibration plate laminated on the channel member;

a piezoelectric element positioned on the vibration plate; and a manifold member positioned on the vibration plate and positioned opposite to the channel member with respect to the vibration plate in the laminating direction and disposed in a different position from the piezoelectric element in a perpendicular direction perpendicular to the laminating direction, the manifold member including at least a particular portion of the first manifold and at least a particular portion of the second manifold; and a bypass path positioned opposite to the individual channel with respect to the filter in the laminating direction, the bypass path providing fluid communication between the first manifold and the second manifold not via the individual channel.

2. The liquid ejection head according to claim 1, further comprising:

a partition wall separating the first manifold and the second manifold in the perpendicular direction, wherein the bypass path penetrates the partition wall.

3. The liquid ejection head according to claim 2, wherein the individual channel is positioned without overlapping the first manifold and the second manifold when viewed in the perpendicular direction to the laminating direction.

4. The liquid ejection head according to claim 1, wherein the vibration plate has the filter.

5. The liquid ejection head according to claim 4, wherein the vibration plate defines at least a portion of the bypass path.

6. The liquid ejection head according to claim 1, wherein the manifold member defines at least a portion of the bypass path.

7. The liquid ejection head according to claim 6, wherein the manifold member includes:

a through hole penetrating through the manifold member in the laminating direction; and a groove being opened toward the vibration plate with respect to the laminating direction, wherein the through hole corresponds to the at least a particular portion of the first manifold and the groove corresponds to the at least a particular portion of the second manifold, and wherein the bypass path has openings in surfaces defining the groove and the surfaces extend intersecting with the laminating direction.

8. The liquid ejection head according to claim 6, wherein the manifold member includes:

a through hole penetrating through the manifold member in the laminating direction; and a groove being opened toward the vibration plate with respect to the laminating direction, wherein the through hole corresponds to the at least a particular portion of the first manifold and the groove corresponds to the at least a particular portion of the second manifold, and wherein the bypass path has openings in surfaces defining the groove and the surfaces extend intersecting with the perpendicular direction.

9. The liquid ejection head according to claim 1, wherein the plurality of members includes a first plate, a second plate, a third plate, a fourth plate, and a fifth plate laminated one above another in the laminating direction, wherein the first plate has the nozzle, wherein the second plate includes a particular portion of a descender being in fluid communication with the nozzle and a particular portion of a first communication path being in fluid communication with the particular portion of the descender, wherein the third plate includes a further particular portion of the descender, a first wall portion defining a wall surface defining the first communication path extending parallel to the perpendicular direction, and a further particular portion of the first communication path, wherein the fourth plate includes a particular portion of a pressure chamber being in fluid communication with the descender, a second communication path being in fluid communication with the particular portion of the pressure chamber, and a still further particular portion of the first communication path, and wherein the fifth plate includes a further particular portion of the pressure chamber, a second wall portion defining a wall surface defining the second communication path extending parallel to the perpendicular direction, a further particular portion of the first manifold being in communication with the second communication path, and a further particular portion of the second manifold being in communication with the still further particular portion of the first communication path.

10. The liquid ejection head according to claim 9, wherein a resistance imparted to flow of ink through the bypass path is less than a combined resistance that is a sum of individual resistances, each of which is a resistance imparted to flow of ink through a path from the filter to the second communication path and a resistance imparted to flow of ink through the individual channel.

11. The liquid ejection head according to claim 1, wherein the bypass path has a rectangular cross section in a plane perpendicular to a direction in which liquid flows.

12. The liquid ejection head according to claim 1, further comprising:

a first narrowed portion providing fluid communication between the individual channel and the first manifold; and a second narrowed portion providing fluid communication between the individual channel and the second manifold, wherein the first narrowed portion and the second narrowed portion each have a cross-sectional area such that an average of pressures in the individual channel is negative.

13. The liquid ejection head according to claim 1, wherein the first manifold includes a supply manifold that allows liquid to flow into the individual channel, wherein the second manifold includes a return manifold that allows liquid to flow thereinto from the first manifold, and wherein the bypass path is configured to allow liquid to pass therethrough to flow from the supply manifold to the return manifold.

14. The liquid ejection head according to claim 13, further comprising:

an inlet configured to allow liquid to pass therethrough to flow into the first manifold; and a dummy channel configured to allow liquid to flow thereinto from the first manifold, wherein the individual channel includes a first individual channel and a second individual channel, wherein the first individual channel is farther from the inlet than the second individual channel, wherein the dummy channel is positioned opposite to the inlet with respect to the first individual channel, and wherein the bypass path is positioned opposite to the inlet with respect to the dummy channel.

15. The liquid ejection head according to claim 13, further comprising an inlet configured to allow liquid to pass therethrough to flow into the first manifold, wherein a cross-sectional area of a cross section of the first manifold in a plane perpendicular to a direction in which liquid flows in the first manifold becomes smaller as the first manifold extends away from the inlet.

16. The liquid ejection head according to claim 13, further comprising an outlet configured to allow liquid to pass therethrough from the second manifold, wherein a cross-sectional area of a cross section of the second manifold in a plane perpendicular to a direction in which liquid flows in the second manifold becomes smaller as the return manifold extends toward the outlet.

17. A liquid ejection head comprising:

an individual channel having a nozzle;

a first manifold being in fluid communication with the individual channel;

a filter disposed in the first manifold;

a second manifold being in fluid communication with the individual channel;

a first bypass path positioned opposite to the individual channel with respect to the filter in a direction perpendicular to a surface extending direction of the filter, the first bypass path providing fluid communication between the first manifold and the second manifold not via the individual channel; and a second bypass path positioned between the filter and the individual channel, the second bypass path providing fluid communication between the first manifold and the second manifold not via the individual channel.

18. The liquid ejection head according to claim 17, wherein the first bypass path is configured to impart less resistance to flow of liquid therethrough than the second bypass path imparts a resistance to flow of ink therethrough than the second bypass path.

19. A liquid ejection head comprising:

an individual channel having a nozzle;

a first manifold being in fluid communication with the individual channel;

a filter disposed in the first manifold;

a second manifold being in fluid communication with the individual channel; and a bypass path positioned opposite to the individual channel with respect to the filter in a direction perpendicular to a surface extending direction of the filter, the bypass path providing fluid communication between the first manifold and the second manifold not via the individual channel;

an inlet configured to allow liquid to pass therethrough to flow into the first manifold; and a dummy channel configured to allow liquid to flow thereinto from the first manifold, wherein the individual channel includes a first individual channel and a second individual channel, wherein the first individual channel is farther from the inlet than the second individual channel, wherein the dummy channel is positioned opposite to the inlet with respect to the first individual channel, and wherein the bypass path is positioned opposite to the inlet with respect to the dummy channel.

20. The liquid ejection head according to claim 19, wherein a cross-sectional area of a cross section of the first manifold in a plane perpendicular to a direction in which liquid flows in the first manifold becomes smaller as the first manifold extends away from the inlet.

* * * * *